US005654134A

United States Patent [19]

Morimura et al.

[11] Patent Number: 5,654,134

[45] Date of Patent: Aug. 5, 1997

[54] SILVER HALIDE EMULSION

[75] Inventors: Kimiyasu Morimura; Hiroyuki Mifune; Hirotomo Sasaki, all of Kanagawa, Japan

[73] Assignee: Fuji Photo Film Co., Ltd., Kanagawa, Japan

[21] Appl. No.: 699,186

[22] Filed: Aug. 19, 1996

Related U.S. Application Data

[63] Continuation of Ser. No. 439,518, May 11, 1995, abandoned.

[30] Foreign Application Priority Data

May 18, 1994 [JP] Japan ..... 6-104065
Oct. 19, 1994 [JP] Japan ..... 6-253755

[51] Int. Cl.[6] ..... G03C 1/09; G03C 1/34

[52] U.S. Cl. ..... 430/603; 430/611; 430/614

[58] Field of Search ..... 430/603, 611, 430/614

[56] References Cited

U.S. PATENT DOCUMENTS

| | | | |
|---|---|---|---|
| 2,131,038 | 9/1938 | Brooker et al. | 430/614 |
| 3,442,653 | 5/1969 | Dunn | 430/603 |
| 5,236,821 | 8/1993 | Yagihara et al. | 430/600 |
| 5,242,791 | 9/1993 | Hirano et al. | 430/603 |
| 5,320,937 | 6/1994 | Ihama | 430/567 |
| 5,328,820 | 7/1994 | Klaus et al. | 430/569 |
| 5,342,750 | 8/1994 | Sasaki et al. | 430/603 |
| 5,567,571 | 10/1996 | Nishikawa | 430/603 |

FOREIGN PATENT DOCUMENTS

| | | | |
|---|---|---|---|
| 542306 | 5/1993 | European Pat. Off. | 430/603 |
| 638840 | 2/1995 | European Pat. Off. | 430/603 |
| 292980 | 8/1991 | German Dem. Rep. | 430/603 |
| 5-27360 | 2/1993 | Japan | 430/603 |

*Primary Examiner*—Richard L. Schilling
*Attorney, Agent, or Firm*—Sughrue, Mion, Zinn, Macpeak & Seas

[57] ABSTRACT

A silver halide emulsion is disclosed, which is subjected to chemical ripening using a labile tellurium sensitizer and/or a labile selenium sensitizer in the presence of at least one compound represented by formula (I), (II), (III) or (IV) described in the specification.

14 Claims, No Drawings

SILVER HALIDE EMULSION

This is a continuation of application Ser. No. 08/439,518 filed May 11, 1995, now abandoned.

FILED OF THE INVENTION

The present invention relates to a silver halide emulsion, more specifically to a silver halide emulsion improved with respect to fogging and sensitivity.

BACKGROUND OF THE INVENTION

A silver halide emulsion used in a silver halide photographic material is usually subjected to chemical sensitization using various chemical substances so as to obtain desired sensitivity and gradation. Known representative examples of the chemical sensitization are sulfur sensitization, selenium sensitization, tellurium sensitization, sensitization with a noble metal such as gold, reduction sensitization and various sensitization comprising a combination of these.

Recently, demands for a silver halide photographic material to provide high sensitivity, superior graininess and high sharpness and further for rapid processing involving expedited development procedure have been intensified and various improvements have been made on the above-described sensitization methods.

Among sensitization methods, sulfur sensitization, selenium sensitization and tellurium sensitization are generically called as chalcogen sensitization and in particular, sulfur sensitization is most fundamental sensitization and has hitherto been an object of a huge elaboration and improvement.

On the other hand, selenium sensitization is known to have greater sensitization effects than the above-described sulfur sensitization in a common use in the art and described in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patents 2,693,038 and 2,093,209, JP-B-52-34491 (the term "JP-B" as used herein means an "examined Japanese patent publication"), JP-B-52-34492, JP-B-53-295, JP-B-57-22090, JP-A-59-180536 (the term "JP-A" as used herein means an "unexamined published Japanese patent application"), JP-A-59-185330, JP-A-59-181337, JP-A-59-187338, JP-A-59-192241, JP-A-60-150046, JP-A-60-151637, JP-A-61-256738, JP-A-3-4221, JP-A-3-148648, JP-A-3-111838, JP-A-3-116132, JP-A-3-237450, JP-A-4-16838, JP-A-4-25832, JP-A-4-140738, JP-A-4-140739, European Patent 506009A1, British Patents 255,846 and 861,984, and H. E. Spencer et al., *Journal of Photographic Science*, Vol. 31, pp. 158–169 (1986).

The tellurium sensitization has been remarkably progressed in recent years and found to have many advantages such as great sensitization effect as compared with sulfur sensitization, fast development, good reciprocity law characteristics, high color sensitization sensitivity and good pressure effect as described in JP-A-4-204640, JP-A-4-271341, JP-A-4-333043, JP-A-5-11381, JP-A-5-11387, JP-A-5-11388, JP-A-5-45769, JP-A-5-45770, JP-A-5-303157, JP-A-6-27573, JP-A-6-208184 and JP-A-6-208186.

However, although the selenium sensitization has greater sensitization effect than the sulfur sensitization commonly used in the art, it suffers from outstanding occurrence of fog and is also prone to cause softening. Further, although the tellurium sensitization has the above-described predominant property, when the tellurium sensitization is applied to a practical emulsion containing various additives or a gold sensitizer is used in combination to achieve higher sensitivity, unintended fog is generated. Accordingly, techniques for reducing fogging without impairing sensitivity and storability have been demanded.

SUMMARY OF THE INVENTION

A first object of the present invention is to provide a silver halide emulsion high in sensitivity and low in fogging.

A second object of the present invention is to provide a silver halide emulsion excellent in reciprocal law characteristics, high in color sensitization sensitivity, capable of fast development, low in fogging and high in sensitivity.

A third object of the present invention is to provide a chemical sensitization method for the above-described silver halide emulsion.

DETAILED DESCRIPTION OF THE INVENTION

The above-described objects have been achieved by a silver halide emulsion which is subjected to chemical ripening using a labile tellurium sensitizer and/or a labile selenium sensitizer in the presence of at least one compound represented by formula (I), (II), (III) or (IV):

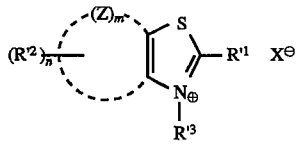

(I)

wherein $R'^1$ represents a hydrogen atom or an alkyl group having from 1 to 6 carbon atoms; m represents 0 or 1, when m is 1, Z represents a condensed benzene ring to which $R'^2$ is substituted and when m is 0, $R'^2$ is substituted to the 4- or 5-position of the thiazolium ring; $R'^2$ represents a hydrogen atom, an alkyl, alkenyl, alkynyl or alkoxy group having from 1 to 6 carbon atoms, or an electron-withdrawing group and when n represents 2 or more, a plurality of $R'^2$ groups may be the same or different or $R'^2$ groups may be combined with each other to form a condensed ring; $R'^3$ represents a hydrogen atom, an alkyl group, an alkenyl group, an alkynyl group or an aralkyl group; $X^-$ represents an anion; and n represents 0, 1, 2 or 3; with the proviso that the groups for $R'^1$, $R'^2$ or $R'^3$ may have further a substituent and the thiazolium ring of formula (I) may be an open ring;

$$R^1-SM \quad \text{(II)}$$

$$R^2-S-S-R^3 \quad \text{(III)}$$

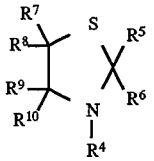

(IV)

wherein $R^1$ represents an aliphatic group or an aromatic group, M represents a hydrogen atom or a cation; $R^2$ and $R^3$ each represents an aliphatic group or an aromatic group and $R^2$ and $R^3$ may be combined to form a ring; and $R^4$, $R^5$, $R^6$, $R^7$, $R^8$, $R^9$ and $R^{10}$ each represents a hydrogen atom, an aliphatic group, an aromatic group or $COOR^{11}$ (wherein $R^{11}$ represents a hydrogen atom or an aliphatic group) and $R^5$ and $R^6$ or $R^7$, $R^8$, $R^9$ and $R^{10}$ may be combined with each other to form a ring.

The silver halide emulsion of the present invention is preferably subjected further to chemical sensitization using a gold sensitizer during or at the chemical ripening.

The silver halide emulsion of the present invention is more preferably subjected to chemical sensitization using a sulfur sensitizer in combination during or at the chemical ripening.

The compounds of the present invention are known as an antifoggant or a stabilizer for a silver halide emulsion and described, for example, in U.S. Pat. Nos. 1,758,576, 2,377,375, 2,759,821, 2,948,614, 3,128,286, 4,416,981 and 5,328,820 but these publications have no concrete description on the action of the compounds to the tellurium sensitization and the action is thus utterly unknown.

As the compound for controlling fogging of a silver halide emulsion, mercapto compounds having an azole heterocyclic ring such as 1-phenyl-5-mercaptotetrazole, 2-mercaptobenzothiazole and 2-mercaptobenzimidazole are well known but these are not preferred for controlling fogging in the tellurium sensitization of the present invention as proved in the examples described later.

An outstanding effect is provided when the compound of the present invention is present at the time of chemical sensitization such as tellurium sensitization or selenium sensitization.

A part of the compounds represented by formulae (I), (II), (III) and (IV) of the present invention are known to activate a non-labile selenium sensitizer as in U.S. Pat. No. 3,442,653 but the combination use with a labile selenium sensitizer inherently dispensable with activation of the present invention and effects given by the combination use are not known and hardly expected due to thoroughly different constitutions, objects and effects.

The compound of formula (I) of the present invention is described below in detail.

Examples of the alkyl group having from 1 to 6 carbon atoms represented by $R'^1$ include a methyl group and a propyl group.

Examples of the alkyl, alkenyl, alkynyl or alkoxy group having from 1 to 6 carbon atoms represented by $R'^2$ include a methyl group, an ethyl group, a hexyl group, an allyl group, a propargyl group and a methoxy group.

The groups represented by $R'^1$ and $R'^2$ may have further a substituent.

Examples of the substituent which can substitute for $R'^1$ or $R'^2$ include a hydroxyl group, a carboxyl group, an amino group, a carbamoyl group, a sulfamoyl group and a halogen atom.

Examples of the electron-withdrawing group represented by $R^2$ include a halogen atom (e.g., Cl), a carboxyl group, a trifluoromethyl group, a cyano group, a nitro group, a sulfo group of $—SO_2R'^4$, an aminosulfonyl group of $—SO_2NHR'^4$, an aminocarbonyl group of $—CONHR'^4$ and an acyl group of $—COR'^4$ (wherein $R'^4$ represents a hydrogen atom, a lower alkyl or a phenyl group).

When a plurality of $R'^2$ groups are combined to form a condensed ring, the compound of formula (I) is, for example, naphthothiazoinum.

Examples of the alkyl, alkenyl, alkynyl or aralkyl group having from 1 to 6 carbon atoms represented by $R'^3$ include a methyl group, a propyl group, a butyl group, a hexyl group, an allyl group, a propargyl group and a benzyl group.

The group represented by $R'^3$ may have further a substituent. Examples of the substituent include a sulfone group, a hydroxyl group, an amino group which may be substituted, a halogen atom, $—SO_2R'^4$, $—SO_2NHR'^4$, $—NHSO_2R'^4$, $—CONHR'^4$, $—NHCOR'^4$, $—COR'^4$, $—COOR'^4$ (where $R'^4$ has the same meaning as above) and a heterocyclic ring (e.g., pyridine, pyrimidine, furan).

Examples of the anion represented by $X^-$ include a halide ion, a nitrate ion, a phosphate ion, a chlorate ion and an anion derived from an organic acid, e.g., formate ion, acetate ion and p-toluenesulfonate (PTS) ion. When $R'^1$, $R'^2$, or $R'^3$ has an anionic group, $X^-$ is not needed.

In the compound of formula (I), the thiazolium ring may be opened as shown below by hydrolysis reaction (equilibrium reaction) and the compound may be in the open ring form.

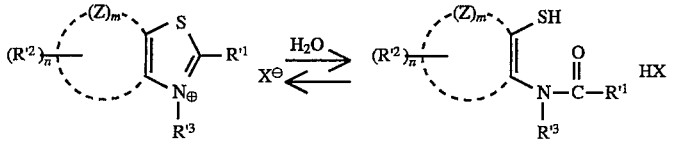

In the compound of formula (I), $R'^1$ is a hydrogen atom, more preferably m is 1 and $R'^1$ is a hydrogen atom.

Specific examples of the compound of formula (I) include the following compounds.

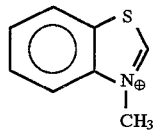

I-1 $I^⊖$

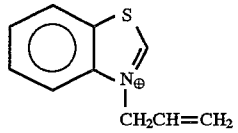

I-2 $Br^⊖$

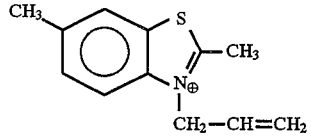

I-3 $Br^⊖$

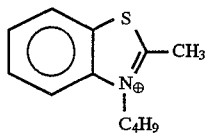

I-4 $Cl^⊖$

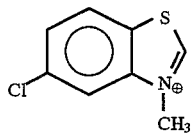

I-5 $Cl^⊖$

-continued

I-6

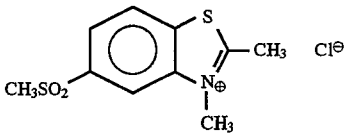

I-7

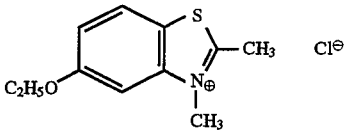

I-8

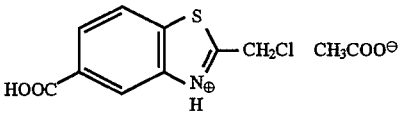

I-9

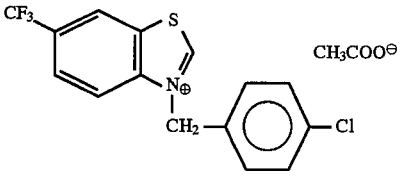

I-10

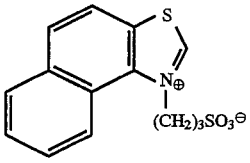

I-11

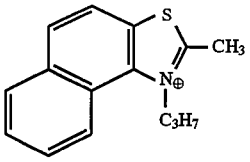

I-12

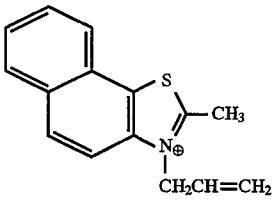

I-13

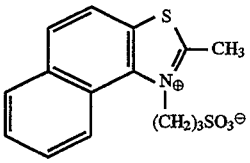

I-14

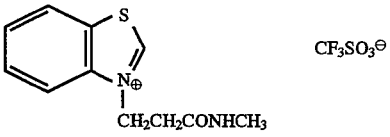

I-15

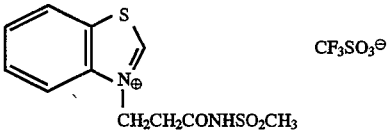

-continued

I-16

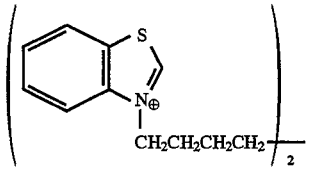

I-17

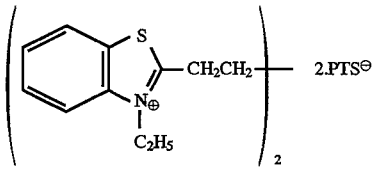

I-18

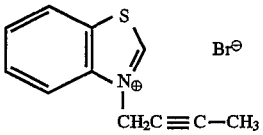

I-19

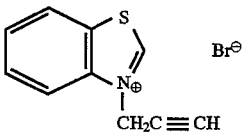

I-20

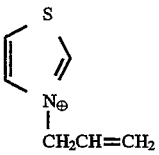

I-21

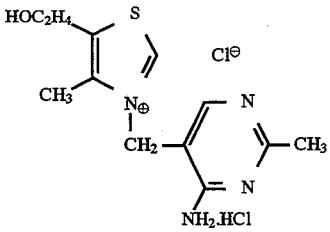

I-22

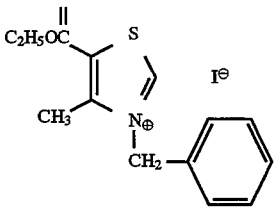

I-23

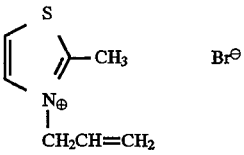

The compounds of formulae (II), (III) and (IV) of the present invention are described below in detail.

The aliphatic group represented by $R^1$ has from 1 to 18 carbon atoms and is an alkenyl group, an alkynyl group, a cycloalkyl group or an aralkyl group and examples thereof include a methyl group, an ethyl group, an n-propyl group, an i-propyl group, an i-butyl group, a t-pentyl group, an n-hexyl group, an m-decyl group, an allyl group, a 3-pentenyl group, a propargyl group, a cyclohexyl group, a benzyl group and a phenetyl group.

The aromatic group represented by $R^1$ is a monocyclic or condensed ring aryl group having from 6 to 20 carbon atoms and examples thereof include a phenyl group and a naphthyl group.

The cation represented by M includes an alkali metal ion (e.g., $Na^+$, $K^+$), an alkaline earth metal ion (e.g., $Ca^{2+}$, $Mg^{2+}$), and an ammonium ion.

The aliphatic group and the aromatic group represented by $R^2$, $R^3$, $R^4$, $R^5$, $R^6$, $R^7$, $R^8$, $R^9$, $R^{10}$ and $R^{11}$ which may be the same or different, each has the same meaning as that defined for $R^1$.

$R^2$ and $R^3$ may be combined to form a 5- or 6-membered ring together with —S—S—.

Examples of the ring formed by $R^5$ and $R^6$ include a cyclohexyl group and a cyclopentyl group and examples of the ring formed by $R^7$, $R^8$, $R^9$, $R^{10}$ and $R^{11}$ include a benzene ring.

The aliphatic group or the aromatic group may be further substituted.

The substituent includes the following. The aliphatic group or the aromatic group may also have a plurality of different substituents.

Representative examples of the substituent include a carboxyl group, an alkyloxycarbonyl group (e.g., ethoxycarbonyl), an aryloxycarbonyl group (e.g., phenoxycarbonyl), an amino group, a substituted amino group (e.g., ethylamino, dimethylamino), a hydroxy group, an alkoxy group (e.g., methoxy), an aryloxy group (e.g., phenoxy), an acyl group (e.g., acetyl), an acylamino group (e.g., acetamide), a ureido group, a nitro group, a sulfonyl group (e.g., phenylsulfonyl), a sulfo group, a mercapto group, an alkylthio group (e.g., methylthio), a cyano group, a phosphono group, a sulfamoyl group (e.g., unsubstituted sulfamoyl, N,N-dimethylsulfamoyl), a carbamoyl group (e.g., unsubstituted carbamoyl, N,N-diethylcarbamoyl), an alkyl group (e.g., ethyl), an aryl group (e.g., phenyl), a heterocyclic group (e.g., morpholino) and a halogen atom (e.g., Cl, Br).

Among the compounds represented by formulae (II), (III) and (IV) of the present invention, preferred are the compounds of formulae (II) and (III), and most preferred is the compound of formula (II).

Specific examples of the compounds represented by formulae (II), (III) and (IV) of the present invention include the following.

$HSCH_2CH(NH_2)COOH$ II-1

$HSCH_2CH_2COOH$ II-2

II-3

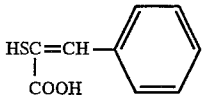

II-4

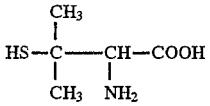

$HSCH_2CH(NH_2)—COOC_2H_5$ II-5

$HSCH_2CH_2N(C_2H_5)_2$ II-6

-continued $HSCH_2CH(SH)—CH_2OH$ II-7

II-8

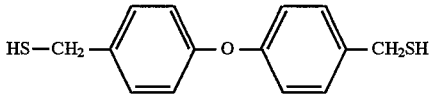

II-9

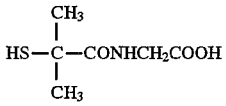

$HSCH_2CH_2SO_3Na$ II-10

$HSCH_2CH_2CH(SH)(CH_2)_4CONH_2$ II-11

II-12

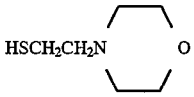

$HSCH_2CH_2NH_2$ II-13

$HSCH_2CH_2OH$ II-14

II-15

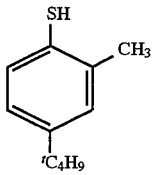

II-16

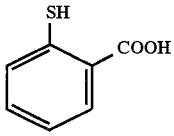

II-17

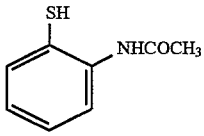

II-18

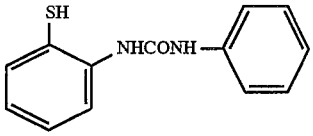

II-19

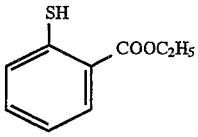

II-20

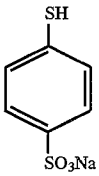

-continued

II-21

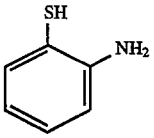

II-22

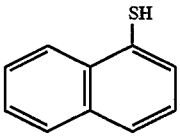

III-1

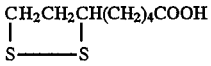

III-2

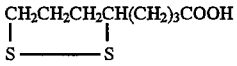

III-3

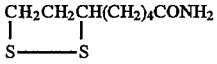

III-4

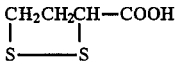

III-5

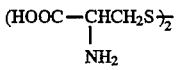

III-6

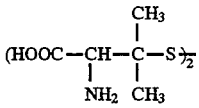

III-7

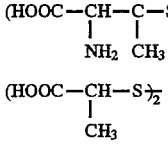

III-8

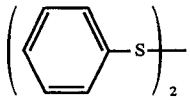

III-9

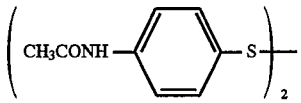

III-10

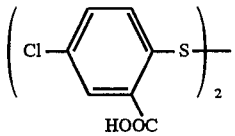

III-11

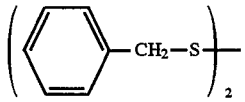

III-12

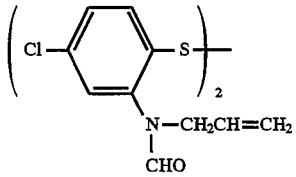

III-13

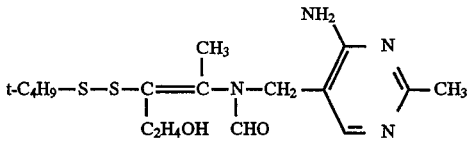

-continued

IV-1

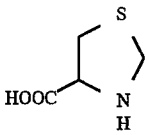

IV-2

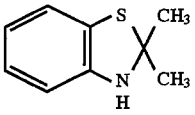

IV-3

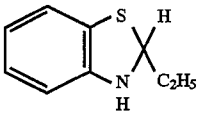

IV-4

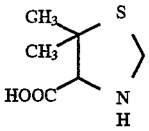

IV-5

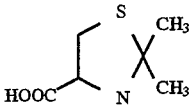

The compound of formula (I), (II), (III) or (IV) of the present invention may be added to be present together at the time of tellurium sensitization or selenium sensitization between the preparation of a silver halide and the completion of chemical sensitization.

The addition amount of the compound of formula (I), (II), (III) or (IV) may be appropriately adjusted depending upon the silver halide used and the addition time but it may be from $1\times10^{-6}$ to $1\times10^{-1}$ mol, preferably from $5\times10^{-6}$ to $5\times10^{-2}$ mol, per mol of the silver halide.

These compounds of the present invention may be added after being dissolved in an organic solvent (e.g., methanol) able to mix with water or in the form of a fine dispersion in a gelatin solution.

The effect of the compound of formula (I), (II), (III) or (IV) of the present invention may be provided in tellurium sensitization and selenium sensitization but particularly outstanding effect is provided in tellurium sensitization.

Examples of the labile tellurium sensitizer used in the present invention include compounds described in JP-A-4-204640, JP-A-4-271341, JP-A-4-333043, JP-A-5-303157, JP-A-6-27573, JP-A-6-175258, JP-A-6-180478, JP-A-6-208184, JP-A-6-208146, Japanese Patent Application Nos. 5-106977, 5-236538, 5-241642, 5-250804 and 5-286916, *J. Chem. Soc. Chem. Commun.*, 635(1980), and *The Chemistry of Organic Selenium Tellurium Compounds*, Vol. 1 (1986) and Vol. 2 (1987), compiled by S. Patai.

Specific examples thereof include:

(1) diacyl tellurides, bis(oxycarbonyl) tellurides and bis(carbamoyl) tellurides (e.g., dibenzoyl telluride, bis(2,6-dimethoxybenzoyl) telluride, bis(ethoxycarbonyl) telluride, bis(N-methyl-N-phenylcarbamoyl) telluride, bis(N-benzyl-N-phenylcarbamoyl) telluride);

(2) diacyl ditellurides, bis(oxycarbonyl) ditellurides and bis(carbamoyl) ditellurides (e.g., dibenzoyl ditelluride, bis(N-methyl-N-phenylcarbamoyl) ditelluride, bis(N,N-diphenylcarbamoyl) ditelluride);

(3) compounds having a P=Te bond (for example, phosphine tellurides (e.g., tributylphosphine telluride, triisobutylphosphine telluride, triisopropylphosphine telluride, n-butyldiisopropylphosphine telluride), tellurophosphoric acid amides (e.g., tris(dimethylamino) phosphane telluride, tris(diethylamino)phosphane telluride), tellurophosphinic acid esters (e.g., diethyltellurophosphinic acid O-ethyl ester ($Et_2(EtO)P{=}Te$)) and tellurophosphonic acid esters (e.g., ethyldiethoxyphosphane telluride));

(4) tellurocarboxylates (e.g., tellurobenzoic acid potassium salt, 2-methoxytellurobenzoic acid potassium salt);

(5) Te-organyl tellurocarboxylates (e.g., Te-(3'-oxobutyl) tellurobenzoate, Te-methyltellurobenzoate);

(6) di(poly)tellurides and tellurides (e.g., diethyl ditelluride, bis(cyanoethyl) ditelluride, dipyridyl ditelluride);

(7) tellurols (e.g., ethanetellurol, sodium ethanetellurolate);

(8) telluroacetals (e.g., 1,1-bis(methyltelluro)butane, tritellurane);

(9) tellurosulfonates (e.g., Te-ethyl benzenetellurosulfonate);

(10) compounds having a P-Te bond (for example, tellurophosphoric acid, Te-organyl esters (e.g., tellurophosphoric acid O,O-diethyl-Te-methyl ester, tellurophosphoric acid O,O-dibutyl-Te-ethyl ester));

(11) Te-containing heterocyclic rings (for example, telluradiazoles); and

(12) tellurocarbonyl compounds (for example, telluroureas (preferably cyclic tellurourea compounds such as N,N'-dimethylethylenetelturourea, N,N'-diethylethylenetellurourea), telluroamides (e.g., dimethyltellurobenzamide, N,N-dipropyl-4-methoxytellurobenzamide) and tellurohydrazides (e.g., (N,N',N'-trimethyl)tellurobenzhydrazide)).

Among these tellurium compounds, preferred are compounds represented by formulae (a), (b), (c) and (d):

$$R_{101}\text{—}(Te)_n\text{—}R_{102} \qquad (a)$$

wherein $R_{101}$ represents an aliphatic group, an aromatic group, a heterocyclic group or —$C(=X_{111})R_{111}$, $R_{102}$ represents an aliphatic group, an aromatic group, a heterocyclic group, a hydrogen atom, a cation, —$C(=X_{112})R_{112}$, wherein $R_{111}$ and $R_{112}$ each represents an aliphatic group, an aromatic group, a heterocyclic group, $OR_{113}$, $NR_{114}R_{115}$, $SR_{116}$ or a hydrogen atom and $X_{111}$ and $X_{112}$ each represents an oxygen atom, a sulfur atom or $NR_{117}$, wherein $R_{113}$, $R_{114}$, $R_{115}$, $R_{116}$ and $R_{116}$ each represents an aliphatic group, an aromatic group, a heterocyclic group or a hydrogen atom, and n represents 1 or 2.

Formula (a) is described below in detail.

In formula (a), the aliphatic group represented by $R_{101}$, $R_{102}$, $R_{111}$, $R_{112}$, $R_{113}$, $R_{114}$, $R_{115}$, $R_{116}$ or $R_{117}$ is preferably an aliphatic group having from 1 to 30 carbon atoms and more preferably a straight, branched or cyclic alkyl, alkenyl, alkynyl or aralkyl group having from 1 to 20 carbon atoms. Examples of the alkyl group, an alkenyl group, an alkynyl group and aralkyl group include a methyl group, an ethyl group, an n-propyl group, an isopropyl group, a t-butyl group, an n-octyl group, an n-decyl group, an n-hexadecyl group, a cyclopentyl group, a cyclohexyl group, an allyl group, a 2-butenyl group, a 3-pentenyl group, a propargyl group, a 3-pentynyl group, a benzyl group and a phenethyl group.

In formula (a), the aromatic group represented by $R_{101}$, $R_{102}$, $R_{111}$, $R_{112}$, $R_{113}$, $R_{114}$, $R_{115}$, $R_{116}$ or $R_{117}$ is preferably an aromatic group having from 6 to 30 carbon atoms and more preferably a monocyclic or condensed ring aryl group having from 6 to 20 carbon atoms. Examples thereof include a phenyl group and a naphthyl group.

In formula (a), the heterocyclic group represented by $R_{101}$, $R_{102}$, $R_{111}$, $R_{112}$, $R_{113}$, $R_{114}$, $R_{115}$, $R_{116}$ or $R_{117}$ is preferably a 3- to 10-membered, saturated or unsaturated heterocyclic group containing at least one of a nitrogen atom, an oxygen atom and a sulfur atom. The heterocyclic group may be monocyclic or may form a condensed ring with other aromatic or heterocyclic ring. The heterocyclic ring is preferably a 5- or 6-membered aromatic heterocyclic ring and examples thereof include a pyridyl group, a furyl group, a thienyl group, a thiazolyl group, an imidazolyl group and a benzimidazolyl group.

These aliphatic group, aromatic group and heterocyclic group may be substituted. The substituent includes the following.

Representative examples of the substituent include an alkyl group, an aralkyl group, an aryl group, an alkoxy group, an aryloxy group, an amino group, an acylamino group, a ureido group, a sulfamoyl group, a carbamoyl group, a sulfonyl group, an alkyloxycarbonyl group, an aryloxycarbonyl group, an acyl group, an acyloxy group, an imido group, an alkylthio group, a halogen atom, a cyano group, a sulfo group, a carboxy group, a hydroxy group, a phosphono group, a nitro group and a heterocyclic group. These groups may be further substituted. When two or more substituents are present, they may be the same or different.

In formula (a), the cation represented by $R_{102}$ is an alkali metal ion such as sodium ion or potassium ion or an ammonium ion.

In formula (a), preferably, $R_{101}$ represents —$C(=X_{111})R_{111}$ and $R_{102}$ represents an aliphatic group, a heterocyclic group or —$C(=X_{112})R_{112}$.

In formula (a), more preferably, $R_{101}$ represents —$C(=O)R_{111}$ and $R_{102}$ represents —$C(=O)R_{112}$, wherein $R_{111}$ and $R_{112}$ each represents $NR_{114}(R_{115})$ or $OR_{116}$, wherein $R_{114}$, $R_{115}$ and $R_{116}$ each represents an aliphatic group, an aromatic group or a heterocyclic group, and n represents 1.

Still more preferably, $R_{101}$ represents —$C(O{=})R_{111}$, $R_{102}$ represents —$C(=O)R_{112}$, $R_{111}$ and $R_{112}$ each represents $NR_{114}(R_{115})$, $R_{114}$ and $R_{115}$ each represents an aliphatic group or an aromatic group and n represents 1.

$$R_{113}(R_{132})P(=Te)R_{133} \qquad (b)$$

wherein $R_{131}$, $R_{132}$ and $R_{133}$ each represents an aliphatic group, an aromatic group, a heterocyclic group, $OR_{134}$, $NR_{135}(R_{136})$, $SP_{137}$, $OSiR_{138}(R_{139})(R_{140})$, X or a hydrogen atom, $R_{134}$ and $R_{137}$ each represents an aliphatic group, an aromatic group, a heterocyclic group, a hydrogen atom or a cation, $R_{135}$ and $R_{136}$ each represents an aliphatic group, an aromatic group, a heterocyclic group or a hydrogen atom, $R_{138}$, $R_{139}$ and $R_{140}$ each represents an aliphatic group and X represents a halogen atom.

Formula (b) is described below in detail.

In formula (b), the aliphatic group, the aromatic group and the heterocyclic group represented by $R_{131}$, $R_{132}$, $R_{133}$, $R_{134}$, $R_{135}$, $R_{136}$, $R_{137}$, $R_{138}$, $R_{139}$ and $R_{140}$ have the same meaning as the aliphatic group, the aromatic group and the heterocyclic in formula (a), respectively. The aliphatic group, the aromatic group and the heterocyclic group represented by $R_{113}$, $R_{132}$, $R_{133}$, $R_{134}$, $R_{135}$, $R_{136}$, $R_{137}$, $R_{138}$, $R_{139}$ and $R_{140}$ each may be substituted by the substituent enumerated in formula (a).

In formula (b), the cation represented by $R_{134}$ or $R_{137}$ represents an alkali metal or ammonium. Examples of the halogen atom represented by X in formula (b) include a fluorine atom, a chlorine atom, a bromine atom and an iodine atom.

In formula (b), preferably, $R_{131}$, $R_{132}$ and $R_{133}$ each represents an aliphatic group or an aromatic group, more preferably an alkyl group or an aromatic group.

$$R_{171}—Te—R_{192} \quad (c)$$

wherein $R_{171}$ represents $—S(O)_n—R_{191}$ or $—P(=Ch)R_{195}(R_{196})$ and $R_{192}$ represents a hydrogen atom, an aliphatic group, an aromatic group, a heterocyclic group, a cation, an acyl group, a carbamoyl group, a sulfamoyl group, a sulfonyl group, a sulfinyl group, an alkoxycarbonyl group or an aryloxycarbonyl group, wherein $R_{191}$, $R_{195}$ and $R_{196}$ each represents an aliphatic group, an aromatic group, a heterocyclic group, an amino group, an ether group, an thioether group, a selenoether group or a telluroether group, Ch represents an oxygen group or a sulfur atom and n represents 1 or 2.

Formula (c) is described below in detail.

In formula (c), the aliphatic group, the aromatic group and the heterocyclic group represented by $R_{191}$, $R_{192}$, $R_{195}$ and $R_{196}$ have the same meaning as the aliphatic group, the aromatic group and the heterocyclic group in formula (a), respectively. The aliphatic group, the aromatic group and the heterocyclic group represented by $R_{191}$, $R_{192}$, $R_{195}$ and $R_{196}$ may be substituted by the substituent enumerated in formula (a).

Examples of the amino group represented by $R_{191}$, $R_{195}$ and $R_{196}$ in formula (c) include an unsubstituted amino group, a methylamino group, an ethylamino group, a dimethylamino group, a diethylamino group, an anilino group and a 2,4-xylydino group.

Examples of the ether group represented by $R_{191}$, $R_{195}$ and $R_{196}$ in formula (c) include a methoxy group, an isopropoxy group, a phenoxy group, a benzyloxy group, a 2-naphthyloxy group and a 2-pyridyloxy group; examples of the thioether group include a methylthio group and a phenylthio group; examples of the selenoether group include a methylseleno group and a phenylseleno group; and examples of the telluroether group include a methyltelluro group.

Examples of the cation represented by $R_{192}$ in formula (c) include an alkali metal ion such as lithium ion and potassium ion and ammonium ions such as ammonium ion. When $R_{192}$ is a cation, Te formally has a negative charge of −1.

Examples of the acyl group represented by $R_{192}$ in formula (c) include a formyl group, an acetyl group, a propionyl group, an isobutyryl group, a valeryl group, a pivaloyl group, an acryloyl group, a pyruvoyl group, a benzoyl group, a 1-naphthoyl group, an m-toluoyl group and a cinnamoyl group; examples of the carbamoyl group include an unsubstituted carbamoyl group, N-ethylcarbamoyl group, N,N-dimethylcarbamoyl group, N,N-diethylcarbamoyl group and N-phenylcarbamoyl group; examples of the sulfamoyl group include an unsubstituted sulfamoyl group, an N-ethylsulfamoyl group, an N,N-dimethylsulfamoyl group, an N,N-diethylsulfamoyl group and an N-phenylsulfamoyl group; examples of the sulfonyl group include a mesyl group, a tosyl group and a tauryl group; and examples of the sulfinyl group include a methylsulfinyl group and a phenylsulfinyl group.

Examples of the alkoxycarbonyl group represented by $R_{192}$ in formula (c) include a methoxycarbonyl group, a benzyloxycarbonyl group and an isopropoxycarbonyl group; and examples of the aryloxycarbonyl group include a phenoxycarbonyl group and a naphthyloxycarbonyl group.

In formula (c), preferably, $R_{171}$ represents $—S(O)_2—R_{191}$ or $—P(=Ch)R_{195}(R_{196})$, $R_{191}$, $R_{195}$ and $R_{196}$ each represents an aliphatic group, an aromatic group or a heterocyclic group, and $R_{192}$ represents an aliphatic group, a heterocyclic group, a cation, an acyl group, a carbamoyl group, a sulfamoyl group, a sulfonyl group, an alkoxycarbonyl group or an aryloxycarbonyl group.

In formula (c), more preferably, $R_{171}$ represents $—P(=Ch)R_{195}(R_{196})$, $R_{195}$ and $R_{196}$ each represents an aromatic group, and $R_{192}$ represents a cation, an acyl group, a carbamoyl group, a sulfamoyl group or a sulfonyl group.

$$R_{211}—C(=Te)—R_{212} \quad (d)$$

wherein $R_{211}$ represents an aliphatic group, an aromatic group, a heterocyclic group or $—NR_{213}(R_{214})$, $R_{212}$ represents $—NR_{215}(R_{216})$, $—N(R_{217})N(R_{218})R_{219}$ or $—OR_{220}$.

$R_{213}$, $R_{214}$, $R_{215}$, $R_{216}$, $R_{217}$, $R_{218}$, $R_{219}$ and $R_{220}$ each represents a hydrogen atom, an aliphatic group, an aromatic group, a heterocyclic group or anacyl group. Preferably, $R_{211}$ and $R_{215}$, $R_{211}$ and $R_{217}$, $R_{211}$ and $R_{218}$, $R_{211}$ and $R_{220}$, $R_{213}$ and $R_{215}$, $R_{213}$ and $R_{217}$, $R_{213}$ and $R_{218}$ or $R_{213}$ and $R_{220}$ may be combined to form a ring.

Formula (d) is described below in detail.

In formula (d), the aliphatic group, the aromatic group and the heterocyclic group represented by $R_{213}$, $R_{214}$, $R_{215}$, $R_{216}$, $R_{217}$, $R_{218}$, $R_{219}$ and $R_{220}$ have the same meaning as the aliphatic group, the aromatic group and the heterocyclic group in formula (a), respectively. The aliphatic group, the aromatic group and the heterocyclic group represented by $r_{211}$, $R_{213}$, $R_{214}$, $R_{215}$, $R_{216}$, $R_{217}$, $R_{218}$, $R_{219}$ or $R_{220}$ may be substituted by the substituent enumerated in formula (a).

The acyl group represented by $R_{213}$, $R_{214}$, $R_{215}$, $R_{216}$, $R_{217}$, $R_{218}$, $R_{219}$ or $R_{220}$ has the same meaning as the acyl group represented by $R_{192}$ in formula (c).

When $R_{211}$ and $R_{215}$, $R_{211}$ and $R_{217}$, $R_{211}$ and $R_{218}$, $R_{211}$ and $R_{220}$, $R_{213}$ and $R_{215}$, $R_{213}$ and $R_{217}$, $R_{213}$ and $R_{218}$ or $R_{213}$ and $R_{220}$ are combined to form a ring, the group constituting the ring includes a substituted or unsubstituted alkylene group (which may contain an ether group, thioether group or a substituted or unsubstituted amino group, e.g., methylene, ethylene, propylene, butylene, hexylene, 1-methylethylene, $—CH_2CH_2OCH_2CH_2—$, $—CH_2CH_2NHCH_2CH_2—$), a substituted or unsubstituted aralkylene group (e.g., benzylidene) and a substituted or unsubstituted arylene group (e.g., phenylene, naphthylene).

In formula (d), preferably, $R_{211}$ represents an aromatic group, a heterocyclic group or $—NR_{213}(R_{214})$, $R_{212}$ represents $—NR_{215}(R_{216})$ or $—N(R_{217})N(R_{218})R_{219}$ and $R_{211}$ and $R_{215}$, $R_{211}$ and $R_{217}$, $R_{211}$ and $R_{218}$, $R_{211}$ and $R_{215}$, $R_{213}$ and $R_{217}$, or $R_{213}$ and $R_{218}$ are combined to form a ring.

In formula (d), $R_{211}$ represents an aromatic group or $—NR_{213}(R_{214})$, $R_{212}$ represents $—NR_{215}(R_{216})$ or $—N(R_{217})N(R_{218})R_{219}$ and $R_{211}$ and $R_{215}$, $R_{211}$ and $R_{217}$, $R_{211}$ and $R_{218}$, $R_{213}$ and $R_{215}$, $R_{213}$ and $R_{217}$, or $R_{213}$ and $R_{218}$ are combined through the alkylene or arylene group to form a ring.

Among the above-described compounds, preferred in the present invention are compounds represented by formulae (a), (b) and (c), more preferred are compounds represented by formula (a) and (b).

Specific examples of the compounds used in the present invention are shown below but the present invention is by no means limited to these compounds.

1.
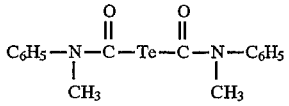
2.
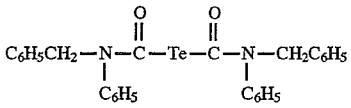
3.
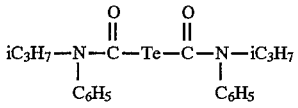
4.
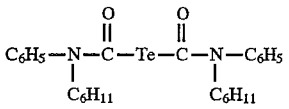
5.
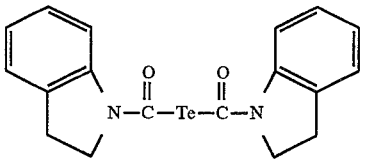
6.
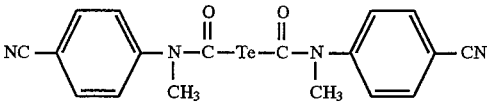
7.
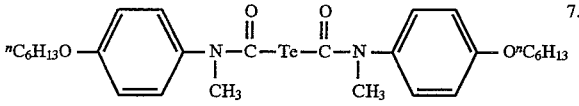
8.
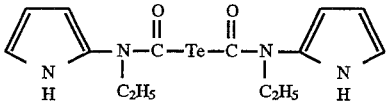
9.
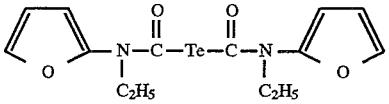
10.
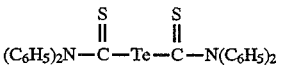
11.
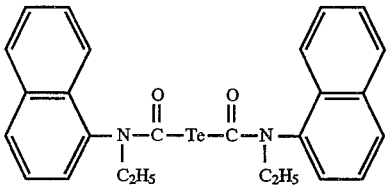
12.
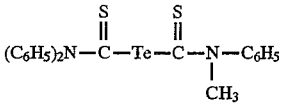
13.
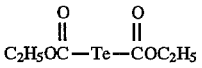
-continued
14.
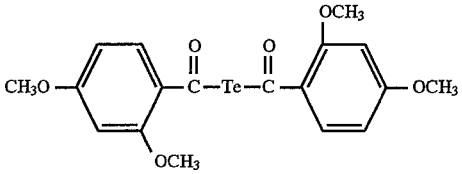
15.
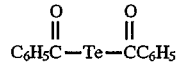
16.
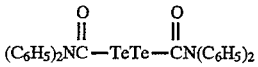
17.
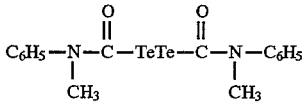
18.
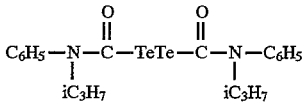
19.
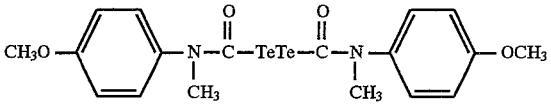
20.
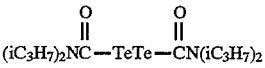
21.
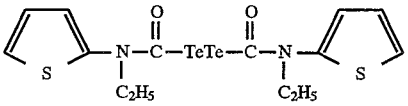
22.
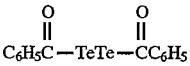
23. $(nC_4H_9)_3P{=}Te$
24. $(iC_4H_9)_3P{=}Te$
25. $(iC_3H_7)_3P{=}Te$
26.
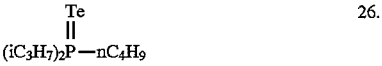
27.
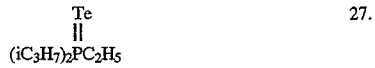
28. $((CH_3)_2N)_3P{=}Te$
29.
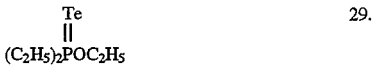
30.
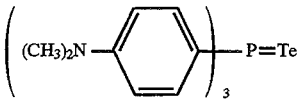
31.
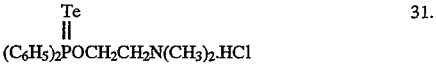
32.
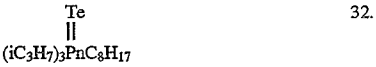

-continued

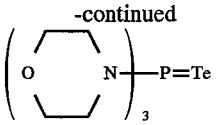

33.

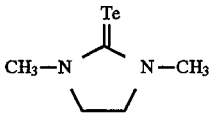

34.

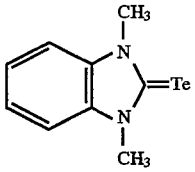

35.

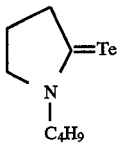

36.

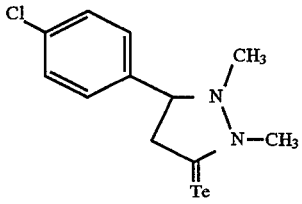

37.

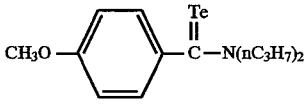

38.

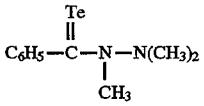

39.

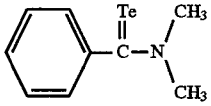

40.

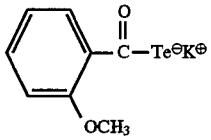

41.

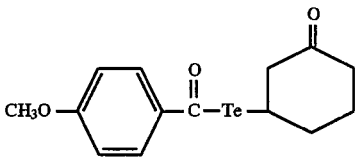

42.

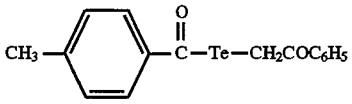

43.

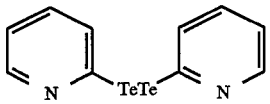

44.

-continued $C_6H_5-COCH_2TeCH_2CO.C_6H_5$ 45.

$C_2H_5Te^{\ominus}Li^{\oplus}$ 46.

$NCCH_2CH_2Te^{\ominus}Na^{\oplus}$ 47.

48.

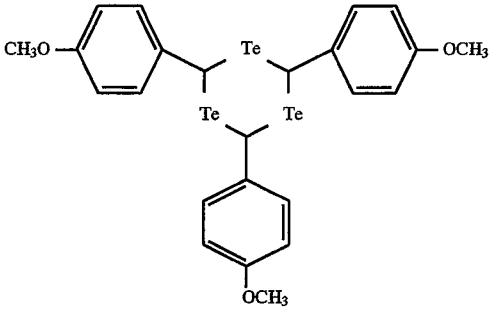

49.

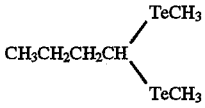

$C_6H_5SO_2TeCH_3$ 50.

51.

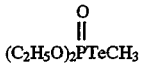

52.

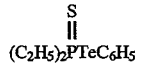

53.

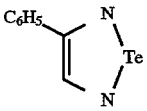

54.

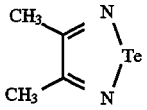

54.

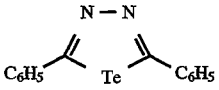

55.

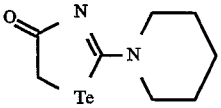

The labile tellurium sensitizer used in the present invention is a compound capable of forming a silver telluride assumed to become a sensitizing nucleus on the surface of or inside the silver halide emulsion grain.

The formation speed of silver telluride can be obtained by the following test method (a) or (b).

(a) When a labile tellurium compound is added in a large amount, since silver telluride produced has an absorption in a visible region, the method described for a sulfur sensitizer in E. Moisar et al., *Journal of Photographic Science*, Vol. 14, p. 181 (1966) and ibid., Vol. 16, p. 102 (1968) can be used. More specifically, $1\times10^{-3}$ mol/mol-Ag of a tellurium compound dissolved in an organic solvent (e.g., methanol) is added to a silver bromide octahedral emulsion having an average grain size of 0.5 μm (containing 0.75 mol of AgBr and 80 g of gelatin per 1 kg of the emulsion) while keeping the pH of 6.3, the pAg of 8.3 and the temperature of 50° C. The emulsion is placed in a cell having a thickness of 1 cm in a spectrophotometer with an integrating sphere and the reflectance (R) at 520 nm is measured by referring to a blank emulsion along the time elapsed. The reflectance is substituted to the Kubelka-Munk formula $(1-R)^2/2R$ and a pseudo first-order reaction rate constant k ($min^{-1}$) is determined from the variation in values obtained.

(b) When the addition amount is small, absorption in the visible region is difficult to detect and accordingly, the determination is carried out as follows. A tellurium sensitizer is added to the same silver bromide as in (a) (50° C., pKg=8.3, pH=6.3), an unreacted tellurium sensitizer is separated by the dipping in an aqueous solution of a halogenosalt or a water-soluble mercapto compound, Te of the silver telluride formed on silver bromide is measured by quantitative analysis according to an atomic absorption method along the time elapsed and a pseudo first-order reaction rate constant k ($min^{-1}$) is determined.

The labile tellurium sensitizers of the present invention have approximately the following silver telluride formation rate constants k according to the above-described test methods.

(1) $8\times10^{-4}$ $min^{-1}$
(16) $6\times10^{-4}$ $min^{-1}$
(17) $2\times10^{-2}$ $min^{-1}$
(25) $7\times10^{-5}$ $min^{-1}$
(26) $2\times10^{-3}$ $min^{-1}$
(28) $2\times10^{-4}$ $min^{-1}$
(34) $1\times10^{-2}$ $min^{-1}$ The reaction rate greatly fluctuates by several figures depending upon not only the kind of the compound but also the silver halide composition of the tested emulsion and the temperature, pAg, and pH at the test. The tellurium sensitizer preferably used in the present invention is a compound capable of forming silver telluride on a specific silver halide emulsion having an intended halide composition and crystal habit. More specifically, compounds capable of forming silver telluride on a silver bromide emulsion in any range of a temperature of from 40° to 95° C., a pH of from 3 to 10 or a pAg of from 6 to 11 are preferred in the present invention and compounds having, in the range above, a pseudo first-order reaction rate constant k of from $1\times10^{-7}$ to $\times10^{-1}$ $min^{-1}$ according to the above-described test methods are more preferred as a labile tellurium sensitizer.

Known selenium sensitizers are a labile selenium sensitizer able to readily form silver selenide upon reaction with silver nitrate in an aqueous solution and a non-labile selenium sensitizer difficult to form silver selenide. The labile selenium sensitizer is used in the present invention.

Preferred examples of the labile selenium sensitizer for use in the present invention include compounds described in U.S. Pat. Nos. 3,297,446 and 3,297,447, JP-A-4-25832, JP-A-4-109240, JP-A-4-147250, JP-A-4-271341, JP-A-5-40324, JP-A-5-224332, JP-A-5-224333, JP-A- 6-43576, JP-A-5-11385, JP-A-6-75328, JP-A-6-175258, JP-A-6-175259, JP-A-6-180478, JP-A-6-208184 and JP-A-6-2081816.

Specific examples of the labaile selenium sensitizer include phosphine selenides (e.g., triphenylphosphine selenide, diphenyl(pentafluorophenyl)phosphine selenide, tris(m-fluorophenyl)phosphine selenide); selenophosphates (e.g., tri-p-tolylselenophosphate, selenophosphoric acid o,o,o-tris(hydroxyethyl) ester); selenophosphinic acid esters; selenophosphonic acid esters; selenoureas (e.g., N,N-dimethylselenourea, selenourea, N-acetyl-N,N',N'-trimethylselenourea, N-trifluoroacetyl-N,N',N'-trimethylselenourea); selenoamides (e.g., N,N-dimethylselenobenzamide, N,N-diethylselenobenzamide); selenoesters (e.g., p-methoxyselenobenzoic acid o-isopropylester, selenobenzoic acid Se-(3'-oxobutyl) ester, p-methoxyselenobenzoic acid Se-(3'-oxocyclohexyl) ester); diacyl selenides (e.g., bis(2,6-dimethoxybenzoyl) selenide, bis(2,4-dimethoxybenzoyl) selenide); dicarbamoyl selenides (e.g., bis(N,N-dimethylcarbamoyl) selenide); bis (alkoxycarbonyl) selenides (e.g., bis(n-butoxycarbonyl) selenide, bis(benzyloxycarbonyl) selenide), triselenanes (e.g., 2,4,6-tris(p-methoxyphenyl)triselenane); diselenides; polyselenides; selenium sulfide; selenoketones (e.g., 4,4'-methoxyselenobenzophenone); selenocarboxylic acids; isoselenocyanates (e.g., p-tolylisoselenocyanate, cyclohexylisoselenocyanate); and colloidal selenium. Among these, preferred are phosphine selenides, selenoamides, dicarbamoyl selenides, bis(alkoxycarbonyl) selenides and selenoesters.

Examples of the gold sensitizer for used in the present invention include chloroauric acid, potassium chloroaurate, potassium aurithiocyanate, gold sulfide and gold selenide and in addition, gold compounds described in U.S. Pat. Nos. 2,642,361, 5,049,484 and 5,049,485 may also be used. Among these, preferred are chloroauric acid, potassium chloroaurate and potassium aurithiocyanate.

In the emulsion of the present invention, a sulfur sensitizer is preferably used in combination.

The sulfur sensitizer used is an labile sulfur compound and labile sulfur compounds described in P. Grafkides, *Chimie et Physique Photographique,* 5th version, Paul Montel (1987) and *Research Disclosure*, Vol. 307, No. 307150 may be used. Specific examples thereof include known active gelatins and sulfur compounds such as thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethylrhodanine), phosphine sulfides (e.g., trimethylphosphine sulfide), thiohydantoins, 4-oxo-oxazolidine-2-thiones, disulfides and polysulfides (e.g., dimorpholine disulfide, hexathiepane), polythionates, elemental sulfur and sodium sulfides. Among these, preferred is hypo.

The use amount of the labile tellurium sensitizer, the labile selenium sensitizer, the sulfur sensitizer or the gold sensitizer may vary depending upon the silver halide emulsion used or chemical ripening conditions but it is usually on the order of from $1\times10^{-8}$ to $1\times10^{-2}$, preferably from $1\times10^{-7}$ to $5\times10^{-3}$ mol, per mol of silver halide.

The chemical sensitization conditions are not particularly restricted in the present invention but in a preferred embodiment, the pAg is from 6 to 11, preferably from 7 to 10, the temperature is from 40° to 95° C., preferably from 45° to 85° C. and the time is from 5 to 240 minutes, preferably from 20 to 200 minutes.

In the present invention, further a reduction sensitizer may also be used and specific examples thereof include stannous chloride, aminoiminomethanesulfinic acid, hydrazine derivatives, borane compounds (e.g., dimethylamineborane), silane compounds and, polyamine compounds. The reduction sensitization is preferably conducted at the grain formation of silver halide.

In the present invention, the chemical sensitization of silver halide is preferably conducted in the presence of a silver halide solvent.

Specific examples of the silver halide solvent include thiocyanates (e.g., potassium thiocyanate), thioether compounds (e.g., compounds described in U.S. Pat. Nos. 3,021,215 and 3,271,157, JP-B-58-30571 and JP-A-60-136736, preferably 3,6-dithia-1,8-octanediol), tetra-substituted thiourea compounds (e.g., compounds described in JP-B-59-11892 and U.S. Pat. No. 4,221,863, preferably tetramethylthiourea), thione compounds described in JP-B-60-1134, mercapto compounds described JP-B-63-29727, mesoionic compounds described in JP-A-60-163042, selenoether compounds described in U.S. Pat. No. 4,782,013, terether compounds described in JP-A-21118566 and sulfites. Among these, preferred are thiocyanates, thioether compounds, tetra-substituted thiourea compound and thione compounds, more preferred are thiocyanates. The use amount is about from $1\times10^{-5}$ to $1\times10^{-2}$ mol per mol of silver halide.

A silver halide emulsion which is chemically sensitized according to the method of the present invention and a silver halide photographic material (sometimes, simply referred to as photographic material) using the emulsion are described below.

The above-described silver halide photographic material comprises silver halide emulsion layers on a support.

The silver halide emulsion used in the present invention is preferably silver bromide, silver iodobromide, silver iodochlorobromide, silver chlorobromide and silver chloride.

The silver halide grain used in the present invention may have a regular crystal form such as cubic form or octahedral form, an irregular crystal form such as spherical form or tabular form or a composite form of these crystal forms. A mixture of grains having various crystal forms may be used but a grain having a regular crystal form is preferred.

The silver halide grain used in the present invention may have different chases between the inside and the surface layer or may comprise a uniform phase. A double or greater structured grain different in iodide composition between the inside and the surface layer of the grain (preferably higher iodide content in the inside) is also preferred. Either a grain where a latent image is mainly formed on the surface (for example, a negative emulsion) or a grain where a latent image is mainly formed inside the grain (for example, an internal latent image-type emulsion, prefogged direct reversal emulsion) may also be used. Preferred is a grain where a latent image is mainly formed on the surface. Also, a grain having a dislocation line is preferred.

As the silver halide emulsion for use in the present invention, a tabular grain emulsion is also preferred where grains having a thickness of 0.5 micron or less, preferably 0.3 micron or less, a diameter of preferably 0.6 micron or less and an average aspect ratio of 3 or more account for 50% or more Of the total project area.

A tabular grain emulsion having good monodispersibility described in JP-A-2-838 is also more preferably used.

The silver halide emulsion for use in the present invention is more preferably a monodispersed emulsion having a statistical coefficient of variation (the value S/d obtained by dividing the standard deviation S by the diameter d in the distribution of the diameter in terms of a sphere-corresponding diameter of the projected area of a grain) of 20% or less. Also, two or more kinds of emulsion may be used in combination.

The photographic emulsion used in the present invention can be prepared according to the methods described, for example, in P. Glafkides, *Chime et Physique Photographigue*, Paul Montel (1967), G. F. Duffin, *Photographic Emulsion Chemistry*, Focal Press (1966) or V. L. Zelikman et al, *Making and Coating Photographic Emulsion*, Focal Press (1964).

At the formation of silver halide grains, in order to control the growth of grains, a silver halide solvent can be used and examples thereof include ammonia, potassium thiocyanate, ammonium thiocyanate, thioether compounds (e.g., those described in U.S. Pat. Nos. 3,271,157, 3,574,628, 3,704,130, 4,297,439 and 4,276,374), thione compounds (e.g., compounds described in JP-A-53-144319, JP-A-53-82408 and JP-A-55-77737) and amine compounds (e.g., compounds described in JP-A-54-100717).

During formation or physical ripening of silver halide grains, a cadmium salt, a zinc salt, a thallium salt, an iridium salt or a complex salt thereof, a rhodium salt or a complex salt thereof, or an iron salt or an iron complex salt may be present together. Among these, preferred are an iridium salt, an iron salt and a rhodium salt.

Gelatin is advantageous as the binder or protective colloid which can be used in the emulsion layer or interlayer of a photographic material but other hydrophilic colloids may be used. Examples thereof include proteins such as gelatin derivatives, graft polymers of gelatin with other polymer, albumin and casein; saccharide derivatives such as cellulose derivatives, e.g., hydroxyethyl cellulose, carboxymethyl cellulose and cellulose sulfate, sodium arginates and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may he a general-purpose lime-processed gelatin, an acid gelatin or an enzyme-processed gelatin as described in *Bull. Soc. Phot. Japan*, No. 16, p. 30 (1966), and a hydrolysate of gelatin can also be used.

The photographic material may contain an inorganic or organic hardening agent in any hydrophilic colloid layer constituting the photographic light-sensitive layer or back layer. Specific example thereof include a chromium salt, an aldehyde salt (e.g., formaldehyde, glyoxal, glutaraldehyde) and N-methylol compounds (e.g., dimethylolurea). An active halogen compound (e.g., 2,4-dichloro-6-hydroxy-1,3,5-triazine and a sodium salt thereof) and an active vinyl compound (e.g., 1,3-bisvinylsulfonyl-2-propanol, 1,2-bis(vinylsulfonylacetamide)ethane, bis(vinylsulfonylmethyl) ether, a vinyl polymer having a vinylsulfonyl group on the side chain) are preferred because they fast harden a hydrophilic colloid such as gelatin to give stable photographic properties. Also, N-carbamoylpyridinium salts (e.g., (1-morpholinocarbonyl-3-pyridinio)methanesulfonate) and haloamidinium salts (e.g., 1-(1-chloro-1-pyridinomethylene)pyrrolidinium-2-naphthalenesulfonate) are excellent in fast hardening.

The silver halide photographic emulsion for use in the present invention is preferably spectrally sensitized by a methine dye or others. Examples of the dye used include a cyanine dye, a merocyanine dye, a complex cyanine dye, a complex merocyanine dye, a holopolar cyanine dye, a hemicyanine dye, a styryl die and a hemioxonol dye. Among these, preferred are dyes belonging to the cyanine dye, the merocyanine dye and the complex merocyanine dye. To these dyes, any nucleus commonly used for cyanine dyes as a basic heterocyclic nucleus can be applied. Examples of the nucleus include pyrroline nuclei such as oxazoline nucleus, thiazoline nucleus, pyrrol nucleus, oxazole nucleus, thiazole nucleus, selenazole nucleus, imidazole nucleus, tetrazole nucleus and pyridine nucleus; nuclei resulting from fusion of an alicyclic hydrocarbon ring to the above-described nuclei; and nuclei resulting from fusion of an aromatic hydrocarbon ring to the above-described nuclei, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus. These nuclei may have a substituent thereon.

To the merocyanine dye or complex merocyanine dye, a 5- or 6-membered heterocyclic nucleus such as pyrazoline -5-one nucleus, thiohydantoin nucleus, 2-thiooxazolidine-2,4-dione nucleus, thiazolidine-2,4-dione nucleus, rhodanine nucleus and thiobarbituric acid nucleus may be applied as a nucleus having a ketomethylene structure.

These sensitizing dyes may be used individually or in combination and the combination use of sensitizing dyes is often used for the purpose of supersensitization. In combination with a sensitizing dye, a substance which by itself does not have a spectral sensitization action or does not substantially absorb a visible light, but exhibits supersensitization may be contained in the emulsion. Examples of the substance include a substituted aminostilbene compound as a nitrogen-containing heterocyclic nucleus ring (e.g., those described in U.S. Pat. Nos. 2,933,390 and 3,635,721), an aromatic organic acid formaldehyde condensate (e.g., those described in U.S. Pat. No. 3,743,510), a cadmium salt and an azaindene compound. In particular, the combinations described in U.S. Pat. Nos. 3,615,613, 3,615,641, 3,617,295 and 3,635,721 are useful.

The silver halide photographic emulsion for use in the present invention may contain various compounds so as to prevent fogging or to stabilize photographic performance, during preparation, storage or photographic processing of a photographic material. Specifically, a large number of compounds known as an antifoggant or a stabilizer may be added and examples thereof include azoles such as benzothiazolium salts, nitroimidazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benzotriazoles, nitrobenzotriazoles and mercaptotetrazoles (preferably 1-phenyl-5-mercaptotetrazoles); mercaptopyrimidines; mercaptotriazines; thioketo compounds, e.g., oxazolinethione; azaindenes, e.g., triazaindens, tetrazaindenes (preferably, 4-hydroxy-6-methyl(1,3,3a,7)tetrazaindene) and pentazaindenes; benzenethiosulfonic acid, benzenesulfinic acid and benzenesulfonic acid amide.

The photographic material may contain one or more surface active agents for various purposes, for example, as a coating aid or for preventing electrification, for improving a sliding property, for improving emulsification or dispersion, for preventing adhesion or for improving photographic properties (e.g., acceleration of development, high contrast, sensitization).

The photographic material may contain in the hydrophilic colloid layer a water-soluble dye for the purpose of irradiation prevention or halation inhibition or for various other purposes. Preferred examples of the dye include an oxonol dye, a hemioxonol dye, a styryl dye, a merocyanine dye, an anthraquinone dye and an azo dye and in addition, a cyanine dye, an azomethine dye, a triarylmethane dye and a phthalocyanine dye are also useful. A oil-soluble dye may be emulsified according to an oil-in-water dispersion method and added to a hydrophilic colloid layer.

The photographic material may have on the support a multi-layer multicolor photographic constitution exhibiting at least two different spectral sensitivities.

A multi-layer color photographic material usually comprises on a support at least one red-sensitive emulsion layer, at least one green-sensitive emulsion layer and at least one blue-sensitive emulsion layer. These layers may be freely arranged according to the purpose. The layers are preferably arranged in the order from the support side of a red-sensitive emulsion layer, a green-sensitive emulsion layer and a blue-sensitive emulsion layer, order of a blue-sensitive emulsion layer, a green-sensitive emulsion layer and a red-sensitive emulsion layer or order of a blue-sensitive emulsion layer, a red-sensitive emulsion layer and a green-sensitive emulsion layer. Any emulsion layer having the same color sensitivity may consist of two or more emulsion layers having different sensitivities to elevate the ultimate sensitivity or may consist of three layers to further improve graininess. A light-insensitive layer may be present between two or more emulsion layers having the same color sensitivity. Emulsion layers having the same certain color sensitivity may be interposed by an emulsion layer having color sensitivity different therefrom. A reflection layer such as fine grain silver halide may be provided under a highly sensitive layer, particularly, a highly sensitive blue-sensitive layer, so as to increase sensitivity.

In general, a red-sensitive emulsion layer, a green-sensitive emulsion layer and a blue-sensitive emulsion layer contain a cyan-forming coupler, a magenta-forming coupler and a yellow forming coupler, respectively, but different combinations may be employed, if desired. For example, a photographic material for pseudo color photograph or semiconductor laser exposure may be provided by the combination with an infrared-sensitive layer.

The photographic material may contain various color couplers and examples thereof are described in patents cited in *Research Disclosure* (RD), No 17643, VII-C to G, already described above.

Preferred examples of the yellow coupler include those described in U.S. Pat. Nos. 3,933,501, 4,022,620, 4,326,024 and 4,401,752, JP-B-58-10739 and British Patents 1,425,020 and 1,476,760.

The magenta coupler is preferably a 5-pyrazolone- or pyrazoloazole-based compound and preferred examples thereof include those described in U.S. Pat. Nos. 4,310,619 and 4,351,897, European Patent No. 73,636, U.S. Pat. Nos. 3,061,432 and 3,725,067, *Research Disclosure* No. 24220 (June, 1984), JP-A-60-33552, *Research Disclosure*, No. 24230 (June, 1984), JP-A-60-43659 and U.S. Pat. Nos. 4,500,603 and 4,540,654.

The cyan coupler includes phenol or naphthol couplers and preferred examples thereof include those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) No. 3,329,729, European Patent 121,365A, U.S. Pat. Nos. 3,446,622, 4,333,999, 4,451,559 and 4,427,767 and European Patent 161,626A.

With respect to the colored coupler for correcting unnecessary absorption of a colored dye, preferred examples thereof are described in *Research Disclosure*, No. 17643, Item VII-G, U.S. Pat. No. 4,163,670, JP-B-57-39413, U.S. Pat. Nos. 4,004,929 and 4,138,258 and British Patent 1,146,368.

With respect to the coupler capable of providing a colored dye having an appropriate diffusibility, preferred examples thereof are described in U.S. Pat. No. 4,366,237, British Patent 2,125,570, European Patent 96,570 and West German Patent (OLS) No. 3,234,533.

Typical examples of the polymerized dye-forming coupler are described in U.S. Pat. Nos. 3,451,820, 4,080,211 and 4,367,282 and British Patent 2,102,173.

A coupler which releases a photographically useful residue upon coupling can also be preferably used in the present invention. Preferred examples of the DIR coupler which releases a development inhibitor include those described in patents cited in the above-described RD 17643, Item VII-F, JP-A-57-15944, JP-A-57-154234, JP-A-60-184248 and U.S. Pat. No. 4,248,962.

With respect to the coupler which imagewise releases a nucleating agent or a development accelerator at the time of development, preferred examples thereof are described in British Patents 2,097,140 and 2,131,188, JP-A-59-157638 and JP-A-59-170840.

In addition, examples of the coupler which can be used in the photographic material include a competing coupler described in U.S. Pat. No. 4,130,427, a poly-equivalent coupler described in U.S. Pat. Nos. 4,283,472, 4,338,393 and 4,310,618, a coupler which releases a DIR redox compound or a DIR coupler described in JP-A-60-185950 and JP-A-62-24252, a coupler which releases a dye capable of recovering the color after the release described in European Patent 173302A, a bleaching accelerator-releasing coupler described in RD Nos. 11449 and 24241 and JP-A-61-201247 and a ligand-releasing coupler described in U.S. Pat. No. 4,553,477.

The coupler for use in the present invention can be incorporated into the photographic material by various known dispersion methods.

Examples of the high boiling point solvent used in oil-in-water dispersion method are described in U.S. Pat. No. 2,322,027.

Specific examples of the high boiling point organic solvent having a boiling point of 175° C. or higher at a normal pressure include phthalic esters (e.g., dibutyl phthalate, dicyclohexyl phthalate, di-2-ethylhexyl phthalate, decyl phthalate, bis(2,4-di-t-aminophenyl) phthalate, bis(2,4-di-t-amylphenyl) isophthalate, bis(1,1,-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate), benzoic esters (e.g., 2-ethylhexylbenzoate, dodecylbenzoate, 2-ethylhexyl-p-hydroxybenzoate), amides (e.g., N,N-diethyldodecaneamide, N,N-diethyllaurylamide, N-tetradecylpyrrolidone), alcohols and phenols (e.g., isostearyl alcohol, 2,4-di-tert-amylphenol), aliphatic carboxylates (e.g., bis(2-ethylhexyl)sebacate, dioctylazelate, glycerol tributylate, isostearyl lactate, trioctyl citrate), aniline derivatives (e.g., N,N-dibutyl-2-butoxy-5-tert-octylaniline) and hydrocarbons (e.g., paraffin, dodecylbenzene, diisopropylnaphthalene). As the auxiliary solvent, an organic solvent having a boiling point of 30° C. or higher, preferably from 50° C. to about 160° C., can be used and typical examples thereof include ethyl acetate, butyl acetate, ethyl propionate, methyl ethyl ketone, cyclohexanone, 2-ethoxyethyl acetate and dimethylformamide.

The process and effect of the latex dispersion and specific examples of the latex for impregnation are described in U.S. Pat. No. 4,199,363 and West German Patent Application (OLS) Nos. 2,541,274 and 2,541,230.

The photographic emulsion layer and other layers of the photographic material are coated on a flexible support in a common use for the photographic material such as plastic film, paper or cloth or on a rigid support such as glass, ceramics and metal. Useful flexible supports are films comprising a semisynthetic or synthetic polymer such as cellulose nitrate, cellulose acetate, cellulose acetic lactate, polystyrene, polyvinyl chloride, polyethylene terephthalate, and polycarbonate and papers having coated or laminated thereon a baryta layer or an α-olefin polymer (e.g., polyethylene, polypropylene, ethylene/butene copolymer). The support may be colored by a dye or a pigment or it may be black for the purpose of light shielding. The surface of the support is usually subjected to undercoating so as to achieve good adhesion to the photographic material and the like. Before or After the undercoating treatment, the support surface may be subjected to glow discharge, corona discharge, ultraviolet light irradiation and flame treatment.

The photographic emulsion layer and other hydrophilic colloid layers can be coated by various known coating method such as dip coating, roller coating, curtain coating or extrusion coating. If desired, a plurality of layers may be coated at the same time according to the method described in U.S. Pat. Nos. 2,681,294, 2,761,791, 3,526,528 and 3,508,947.

The present invention can be applied to various color or black-and-white photographic materials. Representative examples thereof include color negative film for general purpose or movies, color reversal film for slide or television, color paper, color positive film and color reversal paper, a color diffusion transfer type photographic material and a heat developable color photographic material. By using a tricolor coupler mixture described in *Research Disclosure*, No. 17123 (July, 1978) or a black color-forming coupler described in U.S. Pat. No. 4,126,461 and British Patent 2,102,136, the present invention can be applied also to a black-and-white photographic material such as X-ray film. Further, the present invention can be applied to film for platemaking such as lith film or scanner film, X-ray film for direct or indirect medical care or industrial use, negative black-and-white film for photographing, black-and-white printing paper, microfilm for COM or general use, a silver salt diffusion transfer type photographic material or a print-out type photographic material.

In applying the present invention to color diffusion transfer photography, the film unit may have a peel-apart type constitution, an integrated constitution as described in JP-B-46-16356, JP-B-48-33697, JP-A-50-13040 and British Patent 1,330,524 or a non-peeling type constitution as described in JP-A-57-119345.

In any type of the above-described formats, a polymer acid layer protected by a neutral timing layer is advantageously used in view of broadening the allowable range of the processing temperature. In the case of use for color diffusion transfer photography, the polymer acid added may be added to any layer of the photographic material or enclosed in a processing solution container as a developer component.

In the photographic material, various exposure means may be used. Any light source which irradiates a radiant ray corresponding to the sensitivity wavelength of the photographic material may be used as an illumination light source or a writing-in light source. Commonly used is a natural light (sunlight), an incandescent lamp, a halogen atom-sealed lamp, a mercury lamp, a fluorescent lamp or a flash light such as stroboscope or metal combustion flush valve.

A gas, dye solution. or semiconductor laser, a light emitting diode or a plasma light source, which emits light in the wavelength region from the ultraviolet to infrared region, may also be used as a light source for recording. Further, a combination of a linear or surface light source with a microshutter array using a fluorescent screen released from a fluorescent material excited from electron beams (CRT), a liquid crystal (LCD) or a lanthanum-doped lead titanate zirconate (PLZT) can be used as a light exposure means. If desired, the spectral distribution used in exposure may be adjusted by a color filter.

The color developer used in the development of a photographic material is preferably an alkaline aqueous solution comprising as a main component an aromatic primary amine color developing agent. As the color developing agent, an aminophenol-based compound may be useful but a p-phenylenediamine-based compound is preferred and representative examples thereof include 3-methyl-4-amino-N, N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and a sulfate, a hydrochloride and a p-toluenesulfonate of these. The amine in the form of a salt is stable and preferred rather than that in a free state.

The color developer. usually contains a pH buffering agent such as a carbonate, a borate or a phosphate of an alkali metal or a development inhibitor or an antifoggant such as a bromide, a iodide, a benzimidazole, a benzothiazole or a mercapto compound. The color developer may also contain a preservative such as hydroxyamine or sulfite, an organic solvent such as triethanolamine or diethylene glycol; a development accelerator such as benzyl alcohol, polyethylene glycol, a quaternary ammonium salt or an amine; a dye-forming coupler; a competing coupler; a nucleating agent such as sodium borone hydride; an auxiliary developing agent such as 1-phenyl-3-pyrazolidone; a tackifying agent; various chelating agents including aminopolycarboxylic acid, aminopolyphosphonic acid, alkylphosphonic acid and phosphonocarboxylic acid; and an antioxidant described in West German Patent Application (OLS) No. 2,622,950, if desired.

In developing a reversal color photographic material, the color development usually follows black-and-white development. The black-and-white developer uses known black-and-white developing agents such as dihydoxybenzenes (e.g., hydroquinone), 3-pyrazolidones (e.g., 1-phenyl-3-pyrazolidone), and N-methyl-p-aminophenols, individually or in combination.

After the color development, the photographic emulsion layer is usually subjected to bleaching. The bleaching may be conducted at the same time with the fixing or may be conducted separately. For the purpose of rapid processing, the bleaching may be followed by bleach-fixing. Examples of the bleaching agent include compounds of a polyvalent metal such as iron(III), cobalt(III), chromium(IV) or copper (II), peracids, quinones and nitron compounds. Representative examples of the bleaching agent include ferricyanides; bichromates; organic complex salts of iron(III) or cobalt (III), e.g., complex salts of an aminopolycarboxylic acid such as ethylenediaminetetraacetate, diethyleneaminepentaacetate, nitrilotriacetate or 1,3-diamino-2-propanoltetraacetate or of an organic acid such as citric acid, tataric acid or malic acid; manganates; persulfates; and nitrosophenols. Among these, an ethylenediaminetetraacetato iron(III) salt, a diethylenetriaminepentaacetato iron(III) salt and a persulfate are preferred in view of rapid processing and environmental conservation. The ethylenediaminetetraacetato iron(III) complex salt is particularly useful for the sole bleaching solution or for the bleach-fixing monobath.

A bleaching accelerator may be used, if desired, in bleaching solution, bleach-fixing solution or a prebath thereof. Specific examples of useful bleaching accelerators include compounds containing a mercapto group or a disulfide group described in U.S. Pat. No. 3,893,858, West German Patent Nos. 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, JP-A-53-28426 and *Research Disclosure*, No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyethylene oxides described in West German Patent Nos. 966,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940, and in addition, iodide and bromide ions. Among these, preferred are compounds having a mercapto group or a disulfide group in view of a large acceleration effect and more preferred are compounds described in U.S. Pat. No. 3,893,858, West German Patent No. 1,290,812 and JP-A-53-95630. Also, compounds described in U.S. Pat. No. 4,552,834 are preferred. The bleaching accelerator may be incorporated into the photographic material. The bleaching accelerator is particularly useful in bleach-fixing a color photographic material for photographing.

Examples of the fixing agent include thio-sulfates, thiocyanates, thioether-based compounds, thioureas and a large quantity of iodides but a thiosulfate is commonly used. As examples of the preservative for the bleach-fixing solution or fixing solution, sulfites, bisulfites and carbonyl bisulfite adducts are preferred.

The bleach-fixing or fixing is usually followed by water washing and stabilization. In the water washing or stabilization, various known compounds may be added in order to prevent precipitation or to save water. For example, in order to prevent precipitation, a hard water softening agent such as inorganic phosphoric acid, aminopolycarboxylic acid, organic aminopolyphosphonic acid or organic phosphoric acid; a bactericide or antimold for preventing generation of various bacterium, duckweeds or molds; a metal salt represented by magnesium salt, aluminum salt and bismuth salt; a surface active agent for preventing dry load or unevenness; and various film hardening agents may be added, if desired. compounds described in L. E. West, *Phot. Sci. Eng.*, Vol. 6, pp. 344–359 (1965) may also be added. In particular, the addition of a chelating agent or an antimold is useful.

The water washing is usually in a countercurrent water washing system consisting of two or more tanks to save water. Further, in place of water washing, a multi-stage countercurrent stabilization may be conducted as described in JP-A-57-8543. In this processing, a counter-current bath consisting of from 2 to 9 tanks is required. Into the stabilization bath, in addition to the above-described additives, various compounds may be added so as to stabilize an image. Representative examples of the additive include various buffering agents (e.g., using borate, metaborate, borax, phosphate, carbonate, potassium hydroxide, sodium hydroxide, aqueous ammonia, monocarboxylic acid, dicarboxylic acid or polycarboxylic acid in combination) for adjusting the film pH (e.g., pH of from 3 to 9) and aldehydes such as formaldehyde. Also, various additives such as a chelating agent (e.g., inorganic phosphoric acid, aminopolycarboxylic acid, organic phosphoric acid, organic phosphonic acid, aminophosphonic acid, phosphonocarboxylic acid), a bactericide (e.g., benzoisothiazolinone, isothiazolone, 4-thiazolinebenzimidazole, phenol halogenide, sulfanilamide, benzotriazole), a surface active agent, a fluorescent brightening agent and a hardening agent may be used. Two or more compounds having the same or different functions may be used in combination.

As the pH adjusting agent of processed film, various ammonium salts such as ammonium chloride, ammonium nitrate, ammonium sulfate, ammonium phosphate, ammonium sulfite and ammonium thiosulfate are preferably added.

In processing a color photographic material for photographing, the water washing/stabilization step commonly conducted after fixing may be replaced by the above-described stabilization step and water washing step (water saving step). In this case, when the magenta coupler is two equivalent, formalin in the stabilization bath may be excluded.

The water washing or stabilization time of the present invention varies depending upon the kind of photographic material or processing conditions, but it is usually from 20 seconds to 10 minutes, preferably from 20 seconds to 5 minutes.

A color developing agent may be incorporated into the silver halide color photographic material so as to simplify and expedite the processing. The color developing agent is preferably incorporated in the form of various precursors thereof.

Examples of the precursor include indoaniline-based compounds described in U.S. Pat. No. 3,342,597, Schiff basic compounds described in U.S. Pat. No. 3,342,599 and *Research Disclosure*, Nos. 14850 and 15159, aldol compounds described in *Research Disclosure*, No. 13924, metal complexes described in U.S. Pat. No. 3,719,492, urethane-based compounds described in JP-A-53-135628 and various salt form precursors described in JP-A-56-6235, JP-A-56-16133, JP-A-56-59232, JP-A-56267842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531 and JP-A-57-83565.

Various 1-phenyl-3-pyrazolidones may be incorporated into the silver halide photographic material so as to accelerate color development, if desired. Typical examples thereof are described in JP-A-56-64339, JP-A-57-144547, JP-A-57-211147, JP-A-58-50532, JP-A-58-50536, JP-A-58-50533, JP-A-58-50534, JP-A-58-50535 and JP-A-58-115438.

Each processing solution is used at a temperature of from 10° C. to 50° C. In a standard processing, the temperature is from 33° C. to 38° C., but the processing may be accelerated by conducting it at higher temperatures to shorten the processing time or the processing may be conducted at lower temperatures to achieve improvement in image quality or improvement in stability of the processing solution. Further, the photographic material may be processed using cobalt intensification or hydrogen peroxide intensification described in West German Patent No. 2,226,770 and U.S. Pat. No. 3,674,499 for saving silver.

Each processing bath may be equipped inside thereof with a heater, a temperature sensor, a level sensor, a circulation pump, a. filter, a floating lid or a squeegee.

In the case of a continuous processing, the fluctuation in solution composition may be prevented by using a replenisher for each processing solution to achieve a constant finish. The replenishing amount may be reduced to a half of a standard replenishing amount for cutting down the cost.

The photographic material as a color paper is very usually or the color photographic material for photographing is, if desired, subjected to bleach-fixing.

The present invention will be described below in greater detail by referring to the examples but it should not be construed as being limited to these examples.

EXAMPLE I-1

To 1 liter of an aqueous solution containing 0.05 g of potassium bromide and 30 g of gelatin kept at a temperature of 75° C. and a pH of 5, 75 ml of an aqueous silver nitrate solution (1M) and an aqueous potassium bromide solution (1M) were added simultaneously while stirring at a silver voltage kept at 0 mV to the saturated calomel electrode over 4 minutes. Then, 570 ml of an aqueous silver nitrate solution (1M) and an aqueous potassium bromide solution (1M) were further added thereto while keeping the silver voltage at −30 mV over 30 minutes. After the completion of grain. formation, the resulting emulsion was desalted by normal flocculation and washed with water and then thereto gelatin and water were added to adjust the pH to 6.3 and the pAg to 8.5.

The resulting silver bromide emulsion was a monodispersed octahedral emulsion having a grain diameter of 0.25 μm and a coefficient of fluctuation in grain diameter of 12%.

The emulsion was divided into small parts, the temperature was raised to 60° C. and the compound represented by formula (I) (hereinafter referred to as Compound (I)) of the present invention and chloroauric acid (gold sensitizer) were added at intervals of 2 minutes as shown in Table I-1 to effect ripening for 60 minutes to prepare Emulsions 1 to 23. In emulsion 13, Compound (I) was added at the time of water washing of the emulsion. Each of Emulsions 1 to 23, to which the following compounds were added, was coated together with a protective layer by a coextrusion method on a triacetyl cellulose film support having an undercoat layer to provide Samples 1 to 23.

| | |
|---|---|
| (1) Emulsion Layer | |
| Emulsion | Emulsions 1 to 23 (changed every sample) |
| Stabilizer | 4-hydroxy-6-methyl-1,3,3a,7-tetrazaindene |
| (2) Protective Layer | |
| Gelatin | |

Each sample was exposed for sensitometery (10 seconds) and subjected to black-and-white development with Developer M-AA-1 having the following composition at 20° C. for 10 minutes. Then, stopping of development, fixing, water washing and drying were conducted according to a usual method and the density was measured.

The processing solution had the following composition.

| | |
|---|---|
| Metol | 2.5 g |
| L-Ascorbic acid | 10.0 g |
| NABOX | 35.0 g |
| KBr | 1.0 g |
| Water to make | 1.0 liter |
| pH (adjusted to) | 9.6 |

The sensitivity (midpoint sensitivity) is defined by a reciprocal of the exposure amount necessary to give a density of half the sum of fog and the maximum density and shown by a relative value to the value of Sample 1 using only a sulfur sensitizer as 100. The sensitivity and fog values are shown in Table I-1 below.

TABLE I-1

| Sample | Sulfur or Tellurium Sensitizer (addition amount, mol/mol-Ag) | Compound (I) (addition amount, mol/mol-Ag) | Chloroauric Acid (addition amount, mol/mol-Ag) | Fog | Midpoint Sensitivity | |
|---|---|---|---|---|---|---|
| 1 | hypo ($3.2 \times 10^{-5}$) | — | — | 0.03 | 100 | Comparison |
| 2 | " | I-1 ($2.6 \times 10^{-4}$) | — | 0.03 | 102 | Comparison |
| 3 | 26 ($6.4 \times 10^{-5}$) | — | — | 0.09 | 166 | Comparison |
| 4 | " | I-1 ($2.6 \times 10^{-4}$) | — | 0.04 | 178 | Invention |
| 5 | 34 ($3.2 \times 10^{-5}$) | — | — | 0.10 | 152 | Comparison |
| 6 | " | I-1 ($2.6 \times 10^{-4}$) | — | 0.05 | 166 | Invention |
| 7 | hypo ($3.2 \times 10^{-5}$) | — | $1.6 \times 10^{-5}$ | 0.05 | 417 | Comparison |
| 8 | " | I-1 ($2.6 \times 10^{-4}$) | " | 0.03 | 395 | Comparison |
| 9 | 1 ($3.2 \times 10^{-5}$) | — | $1.6 \times 10^{-5}$ | 0.18 | 631 | Comparison |
| 10 | " | I-1 ($2.6 \times 10^{-4}$) | " | 0.06 | 708 | Invention |
| 11 | " | — | $3.2 \times 10^{-5}$ | 0.52 | 582 | Comparison |
| 12 | " | I-1 ($2.6 \times 10^{-4}$) | " | 0.09 | 766 | Invention |
| 13 | " | I-7 ($7.8 \times 10^{-4}$) | " | 0.08 | 760 | Invention |
| 14 | " | I-10 ($2.1 \times 10^{-3}$) | " | 0.10 | 702 | Invention |
| 15 | " | I-18 ($1.3 \times 10^{-4}$) | " | 0.09 | 760 | Invention |
| 16 | " | I-20 ($2.6 \times 10^{-4}$) | " | 0.10 | 710 | Invention |
| 17 | " | I-21 ($2.1 \times 10^{-3}$) | " | 0.12 | 674 | Invention |
| 18 | 2 ($3.2 \times 10^{-5}$) | — | $1.6 \times 10^{-5}$ | 0.20 | 620 | Comparison |
| 19 | " | I-1 ($2.6 \times 10^{-4}$) | " | 0.09 | 655 | Invention |
| 20 | " | I-1 ($5.2 \times 10^{-4}$) | " | 0.05 | 641 | Invention |
| 21 | " | I-2 ($2.6 \times 10^{-4}$) | " | 0.07 | 658 | Invention |

TABLE I-1-continued

| Sample | Sulfur or Tellurium Sensitizer (addition amount, mol/mol-Ag) | Compound (I) (addition amount, mol/mol-Ag) | Chloroauric Acid (addition amount, mol/mol-Ag) | Fog | Midpoint Sensitivity | |
|---|---|---|---|---|---|---|
| 22 | " | Comparative Compound A ($2.6 \times 10^{-4}$) | " | 0.18 | 608 | Comparison |
| 23 | " | Comparative Compound A ($1 \times 10^{-3}$) | " | 0.08 | 421 | Comparison |

Comparative Compound A: 1-phenyl-5-mercaptotetrazole

As is clearly seen from the results of Table I-1, in the case of the sole use of a sulfur sensitization (hypo), the fog was inherently low and no change was obtained even when Compound (I) of the present invention was used in combination. When Compound (I) of the present invention was used in combination with the tellurium sensitizer which provided high sensitivity but was likely to cause fog, the fogging was stopped and at the same time, the midpoint sensitivity was increased. This advantageous change was more conspicuous when gold sensitization was conducted thereafter. On the other hand, Comparative Compound (A) which is a conventionally well-known antifoggant had to be added in a large amount to prevent fogging and caused reduction in sensitivity.

EXAMPLE I-2

A silver bromide tabular grain having a thickness of 0.1 μm and a circle-corresponding diameter of 0.7 μm was prepared as a seed crystal. The seed crystal containing 6 g of Ag was dissolved in 1.0 l of distilled water, the pAg and pH were adjusted to 8.2 and 5, respectively, the temperature was kept at 70° C. and vigorous stirring was conducted. Then, grains were formed through the following procedures.

An aqueous $AgNO_3$ (166 g) solution and an aqueous KBr solution were added while keeping the pAg at 8.4.

The temperature was cooled to 55° C. and an aqueous KI (4 g) solution was added at a constant flow rate.

An aqueous $AgNO_3$ (38 g) solution and an aqueous KBr solution were added while keeping the pAg at 8.9.

The mixed solution was cooled to 35° C., washed with water by flocculation according to a usual method, 50 g of gelatin was added thereto and the pH and pAg were adjusted to 6 and 8.3, respectively. The resulting emulsion contained tabular grains having an average sphere-corresponding diameter of 0.9 μm and an aspect ratio of 3 or more, which accounted for 77% of the total projected area.

The emulsion was divided into small parts, each part was heated to 56° C., and anhydro-5-chloro-5'-phenyl-9-ethyl-3,3'-di(3-sulfopropyl)benzoxacarbocyaninehydroxide sodium salt was added thereto. After ten minutes, Compound (I-1) ($2\times10^{-4}$ mol/mol-Ag), Labile Tellurium Sensitizer 1 ($2.1\times10^{-6}$ mol/mol-Ag), chloroauric acid ($3.6\times10^{-6}$ mol/mol-Ag) mixed with potassium thiocynanate ($1.8\times10^{-3}$ mol/mol-Ag), hypo as a sulfur sensitizer ($9\times10^{-6}$ mol/mol-Ag) and a labile selenium sensitizer (pentafluorophenyldiphenylphosphine selenide; $2.1\times10^{-6}$ mol/mol-Ag) were added in this order at intervals of 2 minutes as shown in Table I-2 so that the emulsion was ripened to have an optimal sensitivity at 1/100 second exposure.

Thereafter, following compounds were added thereto:

Magenta coupler

3-{3-[2-(2,4-di-tert-amylphenoxy)butyrylamino]benzoylamino}-1-(2,4,6-trichlorophenyl)pyrazoline-5-one Oil tricresyl phosphate Stabilizer 4-hydroxy-6-methyl-1,3,3a,7-tetrazaindene Antifoggant 1-(m-sulfophenyl)-5-mercaptotetrazole monosodium salt and 1-(p-carboxyphenyl)-5-mercaptotetrazole Coating aid sodium dodecylbenzenesulfonate Hardening agent 1,2-bis(vinylsulfonylacetylamino)ethane Antiseptic phenoxyethanol were added and the resulting solution was coated by a coextrusion method together with a gelatin protective layer containing polymethyl methacrylate fine particles on a triacetyl cellulose film support having an undercoat layer.

Each sample was exposed for sensitometery (1/100 sec.) through a yellow filter and then subjected to the following color development.

Each sample was measured on the density through a green filter. The results obtained on the photographic performance are shown in Table I-2. The relative sensitivity is shown by a relative value of a reciprocal of the exposure amount necessary to obtain an optical density of (fog value +maximum density/2) and that of Sample 25 was taken as 100.

The results are shown in Table I-2 below.

TABLE I-2

| Sample | Compound (I-1) of the Invention (addition amount, mol/mol-Ag) | Tellurium Sensitizer | Sulfur Sensitizer | Selenium Sensitizer | Fog | Relative Sensitivity | |
|---|---|---|---|---|---|---|---|
| 25 | — | — | o | o | 0.29 | 100 | Comparison |
| 26 | o | — | o | o | 0.07 | 109 | Invention |
| 27 | — | o | o | o | 0.42 | 89 | Comparison |
| 28 | o | o | o | o | 0.09 | 132 | Invention |

In the Table above, the mark "o" indicates that the compound or sensitizer was added and the mark "—" indicates not added.

(Processing Step)

| Step | Processing Time | Processing Temperature (°C.) |
|---|---|---|
| Color development | 2 min. 15 sec. | 38 |
| Bleaching | 6 min. 30 sec. | 38 |
| Water washing | 2 min. 10 sec. | 24 |
| Fixing | 4 min. 20 sec. | 38 |
| Water washing (1) | 1 min. 05 sec. | 24 |
| Water washing (2) | 1 min. 00 sec. | 24 |
| Stabilization | 1 min. 05 sec. | 38 |
| Drying | 4 min. 20 sec. | 55 |

Each processing solution had the following composition.

| (Color Developer) | (unit: g) |
|---|---|
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylaminesulfate | 2.4 |
| 4-(N-Ethyl-N-β-hydroxyethylamino)-2-methylaniline sulfate | 4.5 |
| Water to make | 1.0 liter |
| pH | 10.05 |

| (Bleaching Solution) | (unit: g) |
|---|---|
| Ethylenediaminetetraacetato ferrite sodium trihydrate | 100.0 |
| Ethylenediaminetetraacetate disodium salt | 10.0 |
| Ammonium bromide | 140.0 |
| Ammonium nitrate | 30.0 |
| Aqueous ammonia (27 wt %) | 6.5 ml |
| Water to make | 1.0 liter |
| pH | 6.0 |

| (Fixing Solution) | (unit: g) |
|---|---|
| Ethylenediaminetetraacetate disodium salt | 0.5 |
| Sodium sulfite acid | 7.0 |
| Sodium bisulfite | 5.0 |
| Aqueous solution of ammonium thiosulfate (70 wt %) | 170.0 ml |
| Water to make | 1.0 liter |
| pH | 6.7 |

| (Stabilizer) | (unit: g) |
|---|---|
| Formalin (37 wt %) | 2.0 ml |
| Polyoxyethylene-p-monononylphenyl ether (average polymerization: 10) | 0.3 |
| Ethylenediaminetetraacetate disodium salt | 0.05 |
| Water to make | 1.0 liter |
| pH | 5.0–8.0 |

As is clearly seen from the results of Table I-2 above, by using Compound (I) of the present invention, fogging at the tellurium sensitization or selenium sensitization was suppressed low and at the same time, high spectral sensitivity was obtained.

EXAMPLE I-3

To 800 ml of an aqueous solution having dissolved therein 2.3 g of sodium chloride and 25 g of gelatin kept at 55° C. and having a pH of 4.5, an aqueous silver nitrate solution (water was added to 120 g of $AgNO_3$ to make 480 ml) and an aqueous sodium chloride solution (water was added to 42 g of NaCl to make 480 ml) at the same time. The resulting emulsion was a cubic, monodispersed silver chloride emulsion having a grain size in terms of a side length of 0.45 μm.

Thereafter, the emulsion was washed with water by a usual flocculation using a polymer flocculent and desalted and then, 76 g of gelatin and water were added to adjust the pH to 6.2 and the pAg to 7.0 at 40° C.

The emulsion was divided into small parts and after adding a sensitizing dye shown below, each part was subjected to chemical ripening at 53° C. with Compound (I) of the present invention as shown in Table I-3, Labile Tellurium Sensitizer 2 ($4\times10^{-6}$ mol/mol-Ag), sodium benzenethiosulfonate ($8\times10^{-5}$ mol/mol-Ag) and chloroauric acid ($2\times10^{-6}$ mol/mol-Ag).

Thereafter, gelatin, water, a yellow coupler shown below, a dye image stabilizer, a stabilizer (4-hydroxy-6-methy1-1,3,3a,7-tetrazaindene), an antifoggant (1-[3-(3-methylureido) phenyl]-5-mercaptotetrazole), a coating aid (sodium dodecylbenzenesulfonate) and a hardening agent (2,4-dichloro-6-hydroxy-s-triazine sodium salt) were sequentially added thereto and the emulsion was coated together with a gelatin protective layer on a paper support laminated on both sides thereof by polyethylene to obtain samples.

Sensitizing Dye

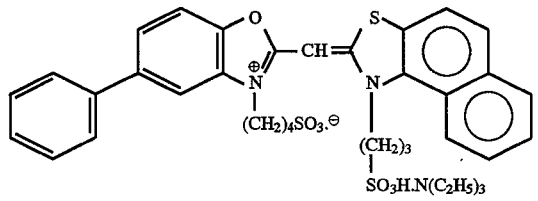

Yellow Coupler

-continued

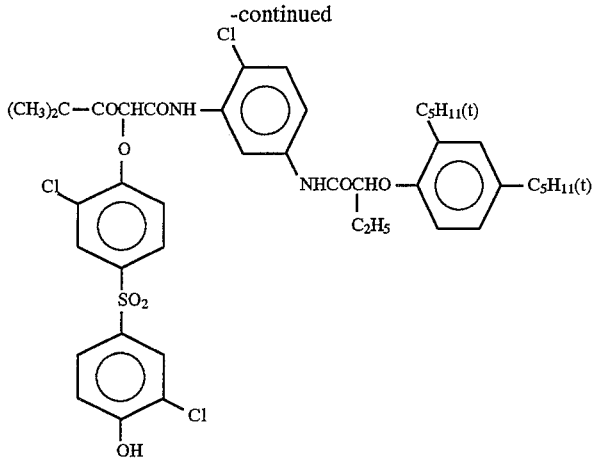

Dye Image Stabilizer

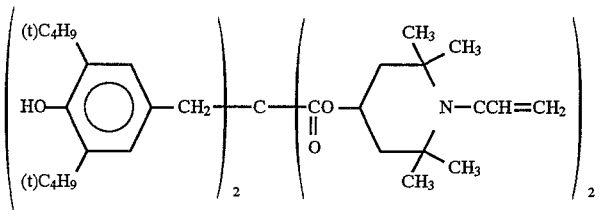

Each sample was exposed (1/10 second) through an optical wedge and then subjected to the following development and the results shown in Table I-3 were obtained. The relative sensitivity was indicated by a relative value of a reciprocal of the exposure amount necessary to give a density of the fog value +0.5 and that of Sample 31 was taken as 100.

| (Formulation of Color Developer) | |
|---|---|
| Development at 33° C. for 60 seconds | |
| Water | 800 ml |
| Diethylenetriaminepentaacetic acid | 1.0 g |
| Sodium sulfite | 0.2 g |
| N,N-Diethylhydroxylamine | 4.2 g |
| Potassium bromide | 0.01 g |
| Sodium chloride | 1.5 g |
| Triethanolamine | 8.0 g |
| Potassium carbonate | 30 g |
| N-Ethyl-N-(β-methanesulfonamidoethyl)-3-methyl-4-aminoaniline sulfate | 4.5 g |
| 4,4-Diaminostilbene-based fluorescent brightening agent (Whitex 4 produced by Sumitomo Chemical Co., Ltd.) | 2.0 g |
| Water to make | 1,000 ml |
| pH with KOH | 10.25 |
| (Formulation of Bleach-Fixing Solution) 35° C., 45 sec. | |
| Ammonium thiosulfate (54 wt %) | 150 ml |
| Sodium sulfite | 15 g |
| $NH_4$[Fe(III) (EDTA)] | 55 g |
| EDTA.2Na | 4 g |
| Glacial acetic acid | 8.61 g |
| Water to make | 1,000 ml |
| | (pH 5.4) |
| (Formulation of Rinsing Solution) 35° C., 90 sec. | |
| EDTA.2Na · $2H_2O$ | 0.4 g |
| Water to make | 1,000 ml |
| | (pH 7.0) |

TABLE I-3

| Sample | Compound (I) of the Invention (addition amount, mol/mol-Ag) | Fog | Relative Sensitivity | |
|---|---|---|---|---|
| 31 | — | 0.19 | 100 | Comparison |
| 32 | I-1 ($4 \times 10^{-4}$) | 0.04 | 125 | Invention |
| 33 | I-4 ($8 \times 10^{-4}$) | 0.09 | 109 | Invention |
| 34 | I-14 ($4 \times 10^{-4}$) | 0.06 | 112 | Invention |
| 35 | I-15 ($4 \times 10^{-4}$) | 0.06 | 110 | Invention |

As is clearly seen from the results of Table I-3, by using Compound (I) of the present invention, fog was reduced and high sensitivity was obtained.

EXAMPLE I-4

A tabular silver iodobromide emulsion was prepared in the same manner as in Example I-2. The emulsion was divided into small parts, each part was heated to 56° C. then thereto anhydro-5-chloro-5'-phenyl -9-ethyl-3,3'-di(3-sulfopropyl)benzooxacarbocyanine hydroxide sodium salt was added and after 10 minutes, Compound (I) of the present invention (shown in Table I-4, $2\times10^{-4}$ mol/mol-Ag), chloroauric acid ($3.6\times10^{-6}$ mol/mol-Ag) mixed with potassium thiocyanate ($1.8\times10^{-3}$ mol/mol-Ag), hypo as a sulfur sensitizer ($9\times10^{-6}$ mol/mol-Ag) and a labile selenium sensitizer (shown in Table I-4, $2.1\times10^{-6}$ mol/mol-Ag) were added in this order at intervals of 2 minutes to ripen the emulsion to have an optimal sensitivity at an exposure of 1/100 second. In Sample 42, Compound (I) was added after the completion of chemical sensitization and immediately before coating.

Thereafter, each emulsion was coated in the same manner as in Example I-2 to obtains Samples 41 to 47. Each sample was subjected to the exposure, processing and evaluation in the same manner as in Example I-2 except for conducting exposure in 1/100 second and further in 100 seconds. The results are shown in Table I-4.

The relative sensitivity in Table I-4 is shown by taking the exposure of 1/100 second as 100.

TABLE I-4

| Sample | Compound (I) of the Invention | Labile Selenium Sensitizer | Relative Sensitivity 1/100 sec. | 100 sec. | |
|---|---|---|---|---|---|
| 41 | — | pentafluorophenyl-diphenyl-phosphine selenide | 100 | 75 | Comparison |
| 42 | (I-1)* | ditto | 102 | 78 | Comparison |
| 43 | (I-1) | ditto | 109 | 92 | Invention |
| 44 | — | N,N-diethylselenobenzamide | 100 | 76 | Comparison |
| 45 | (I-2) | ditto | 112 | 98 | Invention |
| 46 | — | p-methoxyselenobenzoic acid Se-(3'-oxocyclohexyl)ester | 102 | 76 | Comparison |
| 47 | (I-21) | ditto | 108 | 98 | Invention |

*In Sample 42, Compound (I-1) was added after the completion of chemical sensitization and immediately before coating.

The phenomenon such that the relative sensitivity at the exposure of 100 seconds as a long-term low illumination intensity exposure was lower as compared with the exposure of 1/100 second is called as low illumination intensity reciprocity law failure. As is clearly seen from the results of Table I-4, by using Compound (I) of the present invention, the increase in sensitivity at the exposure of 100 seconds became larger than that at the exposure of 1/100 second and thus the low illumination intensity reciprocity law failure was improved.

On the other hand, even when Compound (I) of the present invention was added after chemical sensitization, the effect was frail.

EXAMPLE II-1

A monodispersed octahedral emulsion was prepared in the same manner as in Example I-1.

The thus obtained monodispersed octahedral emulsion was divided into small parts, each part was heated to 60° C. and then thereto a labile tellurium sensitizer or a hypo (sulfur sensitizer), the compound represented by formula (II), (III) or (IV) (hereinafter referred to as CompoUnd (II), (III) or (IV)) of the present invention and chloroauric acid (gold sensitizer) were added at intervals of 2 minutes as shown in Table II-1 to effect ripening for 60 minutes to prepare Emulsions 101 to 129. The same compounds as used in Example I-1 were added to Emulsions 101 to 129 and then coated in the same manner as in Example I-1 to obtain Samples 101 to 129.

The sensitivity (midpoint sensitivity) and fog were measured in the same manner as in Example I-1. The sensitivity is shown by a relative value to the value of Sample 101 as 100.

The sensitivity and fog values are shown in Table II-1.

TABLE II-1

| Sample | Sulfur or Tellurium Sensitizer (addition amount, mol/mol-Ag) | Compound (II), (III) or (IV) (addition amount, mol/mol-Ag) | Chloroauric Acid (addition amount, mol/mol-Ag) | Fog | Midpoint Sensitivity | |
|---|---|---|---|---|---|---|
| 1 | hypo ($3.2 \times 10^{-5}$) | — | — | 0.03 | 100 | Comparison |
| 2 | " | II-16 ($2.6 \times 10^{-4}$) | — | 0.03 | 95 | Comparison |
| 3 | 26 ($6.4 \times 10^{-5}$) | — | — | 0.09 | 166 | Comparison |
| 4 | " | II-16 ($2.6 \times 10^{-4}$) | — | 0.05 | 185 | Invention |
| 5 | 34 ($3.2 \times 10^{-5}$) | — | — | 0.10 | 152 | Comparison |
| 6 | " | II-16 ($2.6 \times 10^{-4}$) | — | 0.06 | 182 | Invention |
| 7 | hypo ($3.2 \times 10^{-5}$) | — | $1.6 \times 10^{-5}$ | 0.05 | 417 | Comparison |
| 8 | " | II-16 ($2.6 \times 10^{-4}$) | " | 0.03 | 331 | Comparison |
| 9 | 1 ($3.2 \times 10^{-5}$) | — | $1.6 \times 10^{-5}$ | 0.18 | 631 | Comparison |
| 10 | " | II-16 ($2.6 \times 10^{-4}$) | " | 0.07 | 680 | Invention |
| 11 | " | — | $3.2 \times 10^{-5}$ | 0.52 | 582 | Comparison |
| 12 | " | II-1 ($9.6 \times 10^{-5}$) | " | 0.05 | 819 | Invention |
| 13 | " | II-2 ($1.3 \times 10^{-4}$) | " | 0.08 | 750 | Invention |
| 14 | " | II-4 ($9.6 \times 10^{-5}$) | " | 0.05 | 825 | Invention |
| 15 | " | II-6 ($9.6 \times 10^{-5}$) | " | 0.08 | 728 | Invention |
| 16 | 1 ($3.2 \times 10^{-5}$) | II-16 ($2.6 \times 10^{-4}$) | $3.2 \times 10^{-5}$ | 0.06 | 762 | Invention |
| 17 | " | II-20 ($2.6 \times 10^{-4}$) | " | 0.09 | 741 | Invention |
| 18 | " | III-1 ($3.2 \times 10^{-4}$) | " | 0.14 | 705 | Invention |
| 19 | " | III-5 ($9.6 \times 10^{-5}$) | " | 0.05 | 796 | Invention |
| 20 | " | III-8 ($2.6 \times 10^{-4}$) | " | 0.12 | 698 | Invention |
| 21 | " | III-9 ($1.3 \times 10^{-4}$) | " | 0.09 | 708 | Invention |
| 22 | " | III-12 ($2.6 \times 10^{-4}$) | " | 0.08 | 741 | Invention |
| 23 | " | IV-1 ($3.2 \times 10^{-4}$) | " | 0.15 | 685 | Invention |
| 24 | " | IV-2 ($3.2 \times 10^{-4}$) | " | 0.10 | 690 | Invention |

TABLE II-1-continued

| Sample | Sulfur or Tellurium Sensitizer (addition amount, mol/mol-Ag) | Compound (II), (III) or (IV) (addition amount, mol/mol-Ag) | Chloroauric Acid (addition amount, mol/mol-Ag) | Fog | Midpoint Sensitivity | |
|---|---|---|---|---|---|---|
| 25 | 2 ($3.2 \times 10^{-5}$) | — | $1.6 \times 10^{-5}$ | 0.20 | 620 | Comparison |
| 26 | " | II-1 ($9.6 \times 10^{-5}$) | " | 0.05 | 705 | Invention |
| 27 | " | II-16 ($2.6 \times 10^{-4}$) | " | 0.05 | 672 | Invention |
| 28 | " | Comparative Compound A ($2.6 \times 10^{-4}$) | " | 0.18 | 608 | Comparison |
| 29 | " | Comparative Compound A ($1.0 \times 10^{-3}$) | " | 0.08 | 421 | Comparison |

Comparative Compound A: 1-phenyl-5-mercaptotetrazole

As is clearly seen from the results of Table II-1, in the case of the sole use of a sulfur sensitization (hypo), the fog was inherently low and no change was obtained even when Compound (II), (III) or (IV) was used in combination. When Compound (II), (III) or (IV) was used in combination with the tellurium sensitizer which provided high sensitivity but was likely to cause fog, the fogging was stopped and at the same time, the midpoint sensitivity was increased. This advantageous change was more conspicuous when gold sensitization was conducted thereafter. On the other hand, Comparative Compound (A), a conventionally well-known antifoggant, had to be added in a large amount to prevent fogging and caused large reduction in sensitivity.

EXAMPLE II-2

Samples 131 to 137 were prepared by conducting preparation and processing in the same manner as in Example I-2 except for replacing Compound (I-1) of the present invention with Compound (II-1), (II-4) or (II-6) as shown in Table II-2.

Each sample was measured on the density through a green filter. The results obtained on the photographic performance are shown in Table II-2. The relative sensitivity is shown by a relative value of a reciprocal of the exposure amount necessary to obtain an optical density of (fog value +maximum density/2)

and that of Sample 131 was taken as 100.

The results are shown in Table II-2 below.

TABLE II-2

| Sample | Compound of the Invention (addition amount, mol/mol-Ag) | Tellurium Sensitizer | Sulfur Sensitizer | Selenium Sensitizer | Fog | Relative Sensitivity | |
|---|---|---|---|---|---|---|---|
| 131 | — | — | o | o | 0.29 | 100 | Comparison |
| 132 | II-1 ($1.2 \times 10^{-4}$) | — | o | o | 0.09 | 112 | Invention |
| 133 | — | o | o | o | 0.42 | 89 | Comparison |
| 134 | II-1 ($1.2 \times 10^{-4}$) | o | o | o | 0.08 | 132 | Invention |
| 135 | II-4 ($1.2 \times 10^{-4}$) | o | o | o | 0.08 | 135 | Invention |
| 136 | II-6 ($1.2 \times 10^{-4}$) | o | o | o | 0.11 | 117 | Invention |
| 137 | Comparative Compound A ($1.2 \times 10^{-4}$) | o | o | o | 0.38 | 85 | Comparative |

In the Table above, the mark "o" indicates that the compound or sensitizer was added and the mark "—" indicates not added.
Comparative Compound A was the same as that used in Example II-1.

As clearly seen from the results of Table II-2 above, by using Compound (II-1), (II-4) or (II-6) of the present invention, fogging at the tellurium sensitization or selenium sensitization was suppressed low and at the same time, high spectral sensitivity was obtained.

EXAMPLE II-3

Samples 141 to 145 were obtained by conducting preparation and processing in the same manner as in Example I-3 except for replacing Compound (I) of the present invention with Compound (II) or (III) as shown in Table II-3.

Each sample was processed and evaluated in the same manner as in Example I-3. The results obtained are shown in Table II-3.

TABLE II-3

| | Compound (II) or (III) of the Invention (addition amount, | | Relative | |
|---|---|---|---|---|
| 141 | — | 0.19 | 100 | Comparison |
| 142 | II-1 ($2 \times 10^{-4}$) | 0.04 | 128 | Invention |
| 143 | II-4 ($2 \times 10^{-4}$) | 0.04 | 126 | Invention |
| 144 | II-17 ($4 \times 10^{-4}$) | 0.08 | 118 | Invention |
| 145 | III-1 ($4 \times 10^{-4}$) | 0.10 | 114 | Invention |

As is clearly seen from the results of Table II-3, by using Compound (II) or (III) of the present invention, fog was reduced and high sensitivity was obtained.

EXAMPLE II-4

Samples 151 to 157 were prepared by conducting the preparation and processing in the same manner as in Example I-4 except for replacing Compound (I) of the present invention with Compound (II), (III) or (IV) as shown in Table II-4 and using a labile selenium sensitizer as shown in Table II-4.

Each sample was processed and evaluated in the same manner as in Example I-4. The results obtained are shown in Table II-4.

TABLE II-4

| Sample | Compound (II), (III) or (IV) of the Invention | Labile Selenium Sensitizer | Relative Sensitivity 1/100 sec. | Relative Sensitivity 100 sec. | |
|---|---|---|---|---|---|
| 151 | — | pentafluorophenyl-diphenyl-phosphine selenide | 100 | 75 | Comparison |
| 152 | (II-4)* | ditto | 104 | 79 | Comparison |
| 153 | (II-4) | ditto | 114 | 98 | Invention |
| 154 | — | N,N-diethylselenobenzamide | 100 | 76 | Comparison |
| 155 | (III-2) | ditto | 110 | 96 | Invention |
| 156 | — | p-methoxyselenobenzoic acid Se-(3'-oxocyclohexyl)ester | 102 | 76 | Comparison |
| 157 | (IV-2) | ditto | 109 | 92 | Invention |

*In Sample 152, Compound (II-4) was added after the completion of chemical sensitization and immediately before coating.

The phenomenon such that the relative sensitivity at the exposure of 100 seconds as a long-term low illumination intensity exposure was lower as compared with the exposure of 1/100 second is called as low illumination intensity reciprocity law failure. As is clear from the results of Table II-4, by using Compound (II), (III) or (IV) of the present invention, the increase in sensitivity at the exposure of 100 seconds became larger than that at the exposure of 1/100 second and thus the low illumination intensity reciprocity law failure was improved.

On the other hand, even when Compound (II) of the present invention was added after chemical sensitization, the effect was frail.

While the invention has been described in detail and with reference to specific embodiments thereof, it will be apparent to one skilled in the art that various changes and modifications can be made therein without departing from the spirit and scope thereof.

What is claimed is:

1. A silver halide emulsion which has been subjected to chemical ripening using a labile tellurium sensitizer and/or a labile selenium sensitizer in the presence of at least one compound represented by formula (I), (II) or (IV):

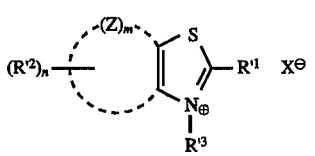

(I)

wherein $R'^1$ represents a hydrogen atom or an alkyl group having from 1 to 6 carbon atoms; m re. presents 0 or 1, when m is 1 and is 1, 2 or 3, Z represents a condensed benzene ring to which $R'^2$ is substituted and when m is 0 and n is 1 or 2, $R'^2$ is substituted to the 4- or 5-position of the thiazolium ring; $R'^2$represents an alkyl, alkenyl, alkyoayl or alkoxy group having from 1 to 6 carbon atoms, or an electron-withdrawing group and when n represents 2 or more, a plurality of $R'^2$ groups may be the same or different or $R'^2$ groups may be combined with each other to form a condensed ring; $R'^3$ represents a hydrogen atom, an alkyl group, an alkenyl group, an alkynyl group or an aralkyl group having from 1 to 6 carbon atoms; $X^-$ represents an anion; and n represents 0, 1, 2 or 3 when m is 1 and n represents 0, 1 or 2 when m is 0; with the proviso that the thiazolium ring of formula (I) may be an open ring;

$$R^1-SM \quad \text{(II)}$$

(IV)

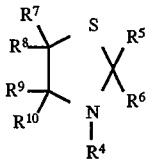

wherein $R^1$ represents an aliphatic group, a phenyl group or a naphthyl group; M represents a hydrogen atom or a cation; and $R^4$, $R^5$, $R^6$, $R^7$, $R^8$, $R^9$ and $R^{10}$ each represents a hydrogen atom, an aliphatic group, an aromatic group or $COOR^{11}$ wherein $R^{11}$ represents a hydrogen atom or an aliphatic group and $R^5$ and $R^6$ or $R^7$, $R^8$, $R^9$ and $R^{10}$ may be combined with each other to form a ring.

2. The silver halide emulsion as claimed in claim 1, wherein the emulsion has been subjected to gold sensitization during the chemical ripening.

3. The silver halide emulsion as claimed in claim 1, wherein the emulsion has been subjected to sulfur sensitization during the chemical ripening.

4. The silver halide emulsion as claimed in claim 1, wherein the labile tellurium sensitizer is used and is a compound represented by formula (a), (b), (c) or (d):

$$R_{101}-(Te)_n-R_{102} \quad \text{(a)}$$

wherein $R_{101}$ represents an aliphatic group, an aromatic group, a heterocyclic group or $-C(=X_{111})R_{111}$, $R_{102}$ represents an aliphatic group, an aromatic group, a heterocyclic group, a hydrogen atom, a cation, or $-C(=X_{112})R_{112}$, wherein $R_{111}$ and $R_{112}$ each represents an aliphatic group, an aromatic group, a heterocyclic group, $OR_{113}$, $NR_{114}R_{115}$, $SR_{116}$ or a hydrogen atom and $X_{111}$ and $X_{112}$ each represents an oxygen atom, a sulfur atom or $NR_{117}$, wherein $R_{113}$, $R_{114}$, $R_{115}$, $R_{116}$ and $R_{117}$ each represents an aliphatic group, an aromatic group, a heterocyclic group or a hydrogen atom, and n represents 1 or 2;

$$R_{131}(R_{132})P(=Te)R_{133} \quad \text{(b)}$$

wherein $R_{131}$, $R_{132}$ and $R_{133}$ each represents an aliphatic group, an aromatic group, a heterocyclic group, $OR_{134}$, $NR_{135}(R_{136})$, $SR_{137}$, $OSiR_{138}(R_{139})(R_{140})$, X or a hydrogen atom, $R_{134}$ and $R_{137}$ each represents an aliphatic group, an aromatic group, a heterocyclic group, a hydrogen atom or a cation, $R_{135}$ and $R_{136}$ each represents an aliphatic group, an aromatic group, a heterocyclic group or a hydrogen atom, $R_{138}$, $R_{139}$ and $R_{140}$ each represents an aliphatic group and X represents a halogen atom;

$$R_{171}—Te—R_{192} \quad (C)$$

wherein $R_{171}$ represents $—S(O)_n—R_{191}$ or $—P(=Ch)R_{195}(R_{196})$ and $R_{192}$ represents a hydrogen atom, an aliphatic group, an aromatic group, a heterocyclic group, a cation, an acyl group, a carbamoyl group, a sulfamoyl group, a sulfonyl group, a sulfinyl group, an alkoxycarbonyl group or an aryloxycarbonyl group, wherein $R_{191}$, $R_{195}$ and $R_{196}$ each represents an aliphatic group, an aromatic group, a heterocyclic group, an amino group, an ether group, a thioether group, a selenoether group or a telluroether group, Ch represents an oxygen group or a sulfur atom and n represents 1 or 2; and $$R_{211}—C(=Te)—R_{212} \quad (d)$$

wherein $R_{211}$ represents an aliphatic group, an aromatic group, a heterocyclic group or $—NR_{213}(R_{214})$, $R_{212}$ represents $—NR_{215}(R_{216})$, $—N(R_{217})N(R_{218})R_{219}$ or $—OR_{220}$;

$R_{213}$, $R_{214}$, $R_{215}$, $R_{216}$, $R_{217}$, $R_{218}$, $R_{219}$ and $R_{220}$ each represents a hydrogen atom, an aliphatic group, an aromatic group, a heterocyclic group or an acyl group or $R_{211}$ and $R_{215}$, $R_{211}$ and $R_{217}$, $R_{211}$, and $R_{218}$, $R_{211}$, and $R_{220}$, $R_{213}$ and $R_{215}$, $R_{213}$ and $R_{217}$, $R_{213}$ and $R_{218}$ or $R_{213}$ and $R_{220}$ may be combined to form a ring.

5. The silver halide emulsion as claimed in claim 1, wherein the labile selenium sensitizer is at least one compound selected from the group consisting of phosphine selenides, selenophosphinic acid esters, selenophosphonic acid esters, selenoureas, selenoamides, selenoesters, diacyl selenides, dicarbamoyl selenides, bis(alkoxycarbonyl) selenides, triselenanes, diselenides, polyselenides, selenium sulfide, selenoketones, selenocarboxylic acids, isoselenocyanates and colloidal selenium.

6. The silver halide emulsion as claimed in claim 1, wherein the compound represented by formula (I), (II) or (IV) is added in an amount of from $1\times10^{-6}$ to $1\times10^{-1}$ mol per mol of the silver halide.

7. The silver halide emulsion as claimed in claim 1, wherein the labile tellurium sensitizer and/or labile selenium sensitizer is added in an amount of from $1\times10^{-8}$ to $1\times10^{-2}$ mol per mol of the silver halide.

8. The silver halide emulsion as claimed in claim 1, wherein the group represented by $R'^1$ or $R'^2$ is substituted by a group selected from the group consisting of a hydroxyl group, a carboxyl group, an amino group, a carbamoyl group, a sulfamoyl group and a halogen atom.

9. The silver halide emulsion as claimed in claim 1, wherein the group represented by $R'^3$ is substituted by a group selected from the group consisting of a sulfone group, a hydroxyl group, an amino group, a halogen atom, $—SO_2R'^4$, $—SO_2NHR'^4$, $—NHSO_2R'^4$, $—CONHR'^4$, $—NHCOR'^4$, $—COR'^4$, $—COOR'^4$ wherein $R'^4$ represents a hydrogen atom, an alkyl group having from 1 to 6 carbon atoms or phenyl group and a heterocyclic group.

10. The silver halide emulsion as claimed in claim 1, wherein the aliphatic group or the aromatic group represented by $R^1$, $R^4$, $R^5$, $R^6$, $R^7$, $R^8$, $R^9$or $R^{10}$ is substituted by a group selected from the group consisting of a carboxyl group, an alkyloxycarbonyl group, an aryloxycarbonyl group, an amino group, a substituted amino group, a hydroxyl group, an alkoxy group, an aryloxy group, an acyl group, an acylamino group, a ureido group, a nitro group, a sulfonyl group, a sulfo group, a mercapto group, an alkylthio group, a cyano group, a phosphono group, a sulfamoyl group, a carbamoyl group, an alkyl group, an aryl group, a heterocyclic group and a halogen atom.

11. A silver halide emulsion as claimed in claim 1, wherein the emulsion has been subjected te chemical ripening using a labile selenium sensitizer selected from the group consisting of phosphine selenides, selenophosphates, selenopkosphinic acid esters, selenophosphonic acid esters, selenoamides, selenoesters, diacyl selenides, dicarbamoyl selenides, bis(alkoxycarbonyl) selenides, triselenanes, diselenides, polyselenides, selenium sulfide, selenoketones and selenocarboxylic acids.

12. A silver halide emulsion as claimed in claim 1, wherein the labile selenium sensitizer is at least one selected from the group consisting of phosphine selenides, selenoamides, dicarbamoyl selenides, bis(alkoxycarbonyl) selenides and selenoesters.

13. A silver halide emulsion as claimed in claim 1, wherein the labile selenium sensitizer is pentafluorophenyldiphenyl-phosphine selenide, N,N-diethylselenobenzamide or p-methoxyselenobenzoic acid Se-(3'-oxocyclohexyl)ester.

14. A silver halide emulsion as claimed in claim 1, wherein the $R'^1$, $R'^2$ or $R'^3$ groups have a substituent selected from the group consisting of a sulfone group, a hydroxyl group, an amino group, a halogen atom, $—SO_2R'^4$, $—SO_2NHR'^4$, $—NHSO_2R'^4$, $—CONHR'^4$, $—NHCOR'^4$, $COR'^4$, $COOR'^4$, and a heterocyclic group, and wherein $R'^4$ represents a hydrogen atom, an alkyl group or a phenyl group.

* * * * *